US006463619B2

(12) United States Patent
Gavney, Jr.

(10) Patent No.: US 6,463,619 B2
(45) Date of Patent: Oct. 15, 2002

(54) SQUEEGEE DEVICE AND SYSTEM

(76) Inventor: James Albert Gavney, Jr., 996 Amarillo, Palo Alto, CA (US) 94303

( * ) Notice: Subject to any disclaimer, the term of this patent is extended or adjusted under 35 U.S.C. 154(b) by 0 days.

(21) Appl. No.: 09/906,230

(22) Filed: Jul. 17, 2001

(65) Prior Publication Data

US 2001/0039689 A1 Nov. 15, 2001

Related U.S. Application Data

(62) Division of application No. 09/330,704, filed on Jun. 11, 1999.

(51) Int. Cl.[7] ..... A47L 1/06; A47L 13/11

(52) U.S. Cl. ..... 15/117; 15/245; D4/116; D32/41

(58) Field of Search ..... 15/105, 110, 111, 15/114, 117, 121, 188, 245, 245.1; D4/116, 118; D32/40, 41

(56) References Cited

U.S. PATENT DOCUMENTS

| | | | | |
|---|---|---|---|---|
| 34,109 A | | 1/1862 | Fenshaw et al. | 15/188 |
| 742,639 A | | 10/1903 | Harlan | 15/188 |
| 907,842 A | * | 12/1908 | Meuzies | |
| 915,251 A | | 3/1909 | Vanderslice | 15/188 |
| 1,000,630 A | | 10/1911 | Clarke | 15/188 |
| 1,128,139 A | * | 2/1915 | Hoffman | |
| 1,191,556 A | | 7/1916 | Blake | 15/117 |
| 1,297,272 A | * | 3/1919 | Strang | |
| 1,526,267 A | | 2/1925 | Dessau | |
| D305,735 S | | 11/1927 | Leeson et al. | |
| 1,910,414 A | | 5/1933 | Varga | 15/245 |
| 1,924,152 A | | 8/1933 | Coney et al. | |
| 2,088,839 A | | 8/1937 | Coney et al. | |
| 2,279,355 A | | 4/1942 | Wilensky | 15/110 |
| 2,334,796 A | * | 11/1943 | Steinmetz et al. | |

(List continued on next page.)

FOREIGN PATENT DOCUMENTS

| | | | |
|---|---|---|---|
| DE | 31 14 507 A1 | 3/1983 | |
| DE | 298 16 488 U1 | 1/1999 | |
| DE | 199 57 639 A1 | 6/2001 | |
| FR | 2 793 136 | 11/2000 | |
| GB | 620151 | 5/1946 | 15/188 |
| WO | WO 98/18364 | 5/1998 | |

*Primary Examiner*—Terrence R. Till
(74) *Attorney, Agent, or Firm*—Haverstock & Owens LLP

(57) ABSTRACT

A device, system and method is disclosed for removing residues from a surface, for treating the surface and/or for applying materials to the surface. The device, system and method of the instant invention utilize a squeegee configuration with at least one curved elongated squeegee which provides wiping in plurality of directions against the surface. The squeegee configuration can also have bristles for brushing the surface and/or apertures for treating the surface. In still further embodiments, the squeegee configuration can have a sponge section and/or an abrasive section. Preferably, the curved elongated squeegee protrudes from a support structure, such as a toothbrush head or other household appliance. Squeegee configurations can include, a spiral squeegee, a continuous squeegee, a squiggling or wave-like squeegee, a squeegee segment and/or combinations thereof.

43 Claims, 20 Drawing Sheets

U.S. PATENT DOCUMENTS

| | | | | | |
|---|---|---|---|---|---|
| 2,534,086 | A | * | 12/1950 | Vosbikian | |
| 2,637,870 | A | | 5/1953 | Cohen | 15/188 |
| 3,103,027 | A | | 9/1963 | Birch | 15/110 |
| 3,110,052 | A | * | 11/1963 | Whitman | |
| 3,181,193 | A | * | 5/1965 | Nobles et al. | |
| 3,230,562 | A | | 7/1966 | Birch | 15/110 |
| 3,491,396 | A | | 1/1970 | Eannarino et al. | 15/104.94 |
| 3,553,759 | A | | 1/1971 | Kramer et al. | 15/110 |
| 3,641,610 | A | | 2/1972 | Lewis, Jr. | |
| 3,939,522 | A | | 2/1976 | Shimizu | |
| 3,969,783 | A | | 7/1976 | Shipman | 15/250.04 |
| 3,992,747 | A | | 11/1976 | Hufton | 15/321 |
| 4,115,893 | A | | 9/1978 | Nakata et al. | 15/110 |
| 4,128,910 | A | | 12/1978 | Nakata et al. | 15/110 |
| 218,431 | A | | 8/1979 | Dunham | 15/245 |
| 4,277,862 | A | | 7/1981 | Weideman | 15/110 |
| 4,438,091 | A | | 1/1984 | Janssen | 15/167 |
| 4,573,920 | A | | 3/1986 | d'Argembeau | 433/141 |
| 4,585,416 | A | | 4/1986 | DeNiro et al. | 433/140 |
| 4,610,043 | A | | 9/1986 | Vezjak | 15/111 |
| 4,763,380 | A | | 8/1988 | Sandvich | 15/160 |
| 4,812,070 | A | | 3/1989 | Marty | 401/289 |
| 4,866,806 | A | | 9/1989 | Bedford | |
| 5,005,246 | A | | 4/1991 | Yen-Hui | 15/111 |
| 5,032,082 | A | | 7/1991 | Herrera | 433/141 |
| D326,019 | S | | 5/1992 | Spangler | D4/118 |
| 5,211,494 | A | | 5/1993 | Baijnath | 401/28 |
| 5,226,197 | A | | 7/1993 | Nack et al. | 15/11 |
| 5,528,793 | A | | 6/1996 | Schbot | 15/245 |
| 5,628,082 | A | | 5/1997 | Moskovich | 15/110 |
| 5,810,856 | A | | 8/1998 | Tveras | 606/161 |
| 5,896,614 | A | | 4/1999 | Flewitt | 15/167.1 |
| 6,010,267 | A | | 1/2000 | Vito | 401/138 |
| 6,041,467 | A | | 4/2000 | Roberts et al. | 15/167.1 |
| 6,065,890 | A | | 5/2000 | Weitz | 401/146 |
| 6,067,684 | A | | 5/2000 | Kweon | 15/110 |
| 6,077,360 | A | | 6/2000 | Takashima | |
| 6,085,379 | A | | 7/2000 | Stafford | 15/167.1 |
| 6,108,854 | A | | 8/2000 | Dingert | 15/188 |
| 6,115,871 | A | | 9/2000 | Royer | 15/167.2 |
| 5,966,771 | A | | 10/2000 | Stroud | 15/117 |
| 6,168,434 | B1 | | 1/2001 | Rohm-Van Diggelen | |
| 6,175,986 | B1 | | 1/2001 | Desormiere et al. | 15/250.48 |
| 6,182,323 | B1 | | 2/2001 | Bahten | 15/230.16 |
| 6,182,365 | B1 | | 2/2001 | Tseng et al. | 30/34.2 |
| 6,190,367 | B1 | | 2/2001 | Hall | 640/290 |
| 6,237,180 | B1 | | 5/2001 | Viego | 15/28 |
| 6,245,032 | B1 | | 6/2001 | Sauer et al. | 601/162 |
| 6,319,332 | B1 | | 11/2001 | Gavney, Jr. et al. | |
| 2001/0039689 | A1 | | 11/2001 | Gavney, Jr. | |

* cited by examiner

SQUEEGEE DEVICE AND SYSTEM

RELATED APPLICATION(S)

This application is a divisional application of the co-pending application Ser. No. 09/330,704 entitled "Squeegee Device and System" filed Jun. 11, 1999, the contents of which are hereby incorporated by reference.

FIELD OF THE INVENTION

This invention relates generally to cleaning devices and cleaning systems. More specifically the invention relates to cleaning devices and cleaning systems that clean surfaces through contact.

BACKGROUND

Cleaning a surface typically involves convection or contact of the surface with a cleaning medium, a mechanic device or a combination of the two. A cleaning medium may be a gas or a liquid that is sprayed or distributed over the surface to remove dirt and debris. There are also several known examples of chemical cleaning systems. For example, strong acids may be used to chemically break down residues on a surface, such as glass. Mechanical cleaning devices, like cleaning media, also involve contact with a surface. Typically, a mechanical cleaning device, such as a brush or a broom, is moved across a surface with a convection cleaning motion to remove, loosen or sweep dirt and debris off the surface.

Many common cleaning systems used for household, automobile and industrial applications either use air or water as a cleaning medium along with brushes or absorbent materials. For example, a vacuum system uses vacuum convention to suck dirt or debris from a surface while a brush, typically attached to an end of a vacuum hose, helps remove or loosen dirt from the surface and thus improving the efficiency and cleaning ability of the vacuum system. Floor cleaning systems commonly include a mechanical mopping device and a bucket of soapy water. Like a vacuum brush, the mechanical mopping device is used to loosen the dirt from the surface and the soapy water, like vacuum convection, provides a medium to remove dirt away or off from the surface.

There are many different cleaning systems, cleaning media and mechanical cleaning devices available for different cleaning applications. Each system, medium or device has specific cleaning characteristics tailored for their specific application. Ultimately, the characteristics of a cleaning system, cleaning medium or cleaning device are tailored to thoroughly clean a surface cheaply and efficiently without causing damage to the surface.

PRIOR ART

One of the most common mechanical cleaning devices is a brush cleaning device. A brush cleaning device, herein, refers to a device with a group or several groupings of bristles. A simple brush cleaning device has one set of bristles that is connected to a handle, such as a floor broom, is used to whisk dirt off a floor surface. Besides household cleaning devices, brushes also are used as applicators for applying liquids or powders to surfaces. Brush devices are also used for grooming hair and for cleaning dentition. Steel or metal brushes are often used for cleaning applications where very abrasive cleaning is required to remove a strongly adhered residue, as for example, when cleaning a barbecue grill.

A second common type of mechanical cleaning device is a sponge device. A sponge device is made of an absorbent material, such as naturally occurring sponge plants, or a porous synthetic material. In the broadest sense, a sponge cleaning device, herein, is also refers to wash clothes and other woven absorbent materials. Sponge devices are particularly well suited to be used in combination with soapy water to clean surfaces where low abrasion is required.

A third common cleaning device is a scouring pad cleaning device. A scouring pad cleaning device is particularly useful for cleaning surface that require a high degree of abrasion to remove a residue. Scouring pad cleaning devices, like sponge cleaning devices, are usually hand held devices but with rough or gritty surfaces. Several known cleaning devices combine the cleaning properties of a scouring pad and a sponge cleaning device. Scouring pad, herein, also refers to sanding paper, steel wool and other fibrous materials with abrasive surface properties. Caution is usual required when using scouring cleaning devices, because they are capable of damaging many common surfaces. Therefore, scouring pad cleaning devices are typically only used to clean very hard robust surfaces or where the intended result is to remove a surface layer in a polishing operation.

Yet another type of cleaning device is a squeegee cleaning device. A squeegee cleaning device is typically made of a soft malleable material that is held in a linear fashion and used for displacing water or cleaning solutions from hard smooth flat surface, such as glass. Squeegees have cleaning characteristics, which help prevent undesirable streaks during cleaning of reflective surfaces, such as glass. Thus, squeegee cleaning devices are particularly useful for cleaning windows and automobile windshields.

While there are clearly many options when choosing a cleaning system, medium or device for a particular cleaning task, many of the devices and systems described above fall short of an ideal cleaning device or system, even when they are used for their intended application. In particular none of the prior art cleaning devices are optimized for cleaning a surface where the surface is soiled with a soft residue which is strongly adhered to the surface.

A dish brush, when used in combination with soapy water, generally does not clean dishes, pots or pan efficiently if a food residue is strongly adhered to the surface of the dish, pot or pan. This situation arises, for example, when spaghetti sauce has either baked on or has dried on to the inside of a cooking pot. The spaghetti sauce residue, while not particularly hard, exhibits excellent adhesion to the walls of the pot. A dish brush, when used in combination with soapy water, relies on soap suds and the brush convection of the soapy water to provide a significant amount of the cleaning action. The brush itself does not provide for the high degree of surface contact required to remove the residue. In cases where soap suds and convection have little or no effect on a residue because of its excellent adhesion properties or low solubility in the soapy water, a brush device generally does not efficiently clean the surface, even if the residue is soft.

Despite the shortcomings of a dish brush cleaning device, it is often preferred over a sponge cleaning device, for several reasons. Firstly, while a sponge cleaning device will provide for more efficient surface contact than the brush, a sponge does not always provide sufficient abrasion or surface contact pressure required to remove a residues. Secondly, a sponge cleaning device is typically hand-held and usually requires the operator's hands to become immersed in the soapy water, which can be an unpleasant experience in the case of cleaning spaghetti sauce residue from the surface of a pot. Lastly, a sponge cleaning device can become irreparably soiled and stained by residues, such as spaghetti sauce, making the sponge cleaning device a highly unattractive addition to the kitchen sink area.

A souring pad device will generally provide sufficient abrasion and surface contact to remove residues from a surface but suffers from all other shortcomings of a sponge cleaning device. Further, a scouring pad cleaning device may destroy or ruin the surface being cleaned, especially if the surface is a cooking pot with a non-stick surface coating.

A second example where known cleaning devices fail to provide efficient cleaning is in cleaning porcelain surfaces. Porcelain is used to fabricate sinks, tubs and deification receptacles, such as toilet bowls, urinals and the like. Stains and fecal material are not readily removed from porcelain surfaces with brush cleaning devices for the same reasons that a brush device does not efficiently remove spaghetti sauce from a pot. A sponge cleaning device also fails to be an ideal cleaning tool for cleaning porcelain surfaces for reasons already mentioned. A more severe limitation of brush and sponge cleaning devices for cleaning porcelain deification receptacles, is that after a single use the cleaning devices can become unsanitary, unsightly and smelly due to residual residue material that gets stuck and is retained between the bristle of the brush device or is strongly absorbed within the sponge material.

Yet another situation where currently available cleaning device fail is in providing for efficient cleaning of enamel surfaces such as teeth or dentition and the like. A toothbrush is the most common cleaning device used for cleaning surfaces of teeth and gum tissue. A tooth brush, unfortunately, is an inefficient device for removing plaque and stains from the enamel surfaces of teeth an is poorly suited for cleaning the surfaces of gum tissue. The inefficiency arises because plaque, while relatively soft, strongly adheres to enamel surfaces of the teeth. Further, plaque is not readily removed from the enamel surfaces by brush convection with water and toothpaste. Thus, in order to remove all the plaque from the enamel surfaces of the teeth, bristles must contact each point on surfaces of the teeth. Even where bristles of the toothbrush contact enamel surfaces of the teeth during a cleaning operation, the toothbrush generally fails to remove stains. A further shortcoming of a tooth brush is that bristle sections of the tooth brush have a propensity to retain water and material that is removed from the teeth after a cleaning operation. A toothbrush will usually remain moist between uses and thus provides an excellent place for the cultivation of bacteria, germs and the like. Yet another shortcoming of a toothbrush is that the toothbrush is too abrasive for cleaning or messaging the surfaces of gum tissue. Thus, dentists generally recommend that their patients use a soft bristled tooth brush. This advise is kindly ignored by most patients because they find that their teeth feel cleaner when a medium or firm bristled tooth brush is used to clean their teeth. Even if a soft bristled toothbrush is used regularly, after years of brushing, gum recession can result from toothbrush abrasion. Gum recession is a condition that exposes highly sensitive portions of the teeth and ultimately leads to temperature sensitivity of the teeth. Temperature sensitivity of the teeth can become so severe for people with gum recession that they can not enjoy warm and hot drinks, such as coffee or tea, or eat cold treats, such as ice cream.

There is a need, therefore, for a cleaning device and system that efficiently removes residues from surfaces of materials typically found in the household and in industry. A cleaning device and system preferably removes residues with strong adhesion to the surfaces with out causing a high degree of abrasion to the surface. More importantly, there is a need for a cleaning device and system that efficiently removes residues, such as plaque, from dentition without causing deleterious abrasion to surrounding gum tissue that can lead to gum recession.

OBJECTS AND ADVANTAGES

Accordingly, it is a primary object of the present invention to provide a squeegee cleaning device and system with a squeegee cleaning portion that provides for a plurality of primary squeegee action directions. The squeegee portion has squeegee segments made from soft malleable materials that efficiently remove residues from surfaces through low abrasion contact with the surface in several directions.

It is a further object of the present invention to provide a squeegee cleaning device and system with a squeegee cleaning portion that provides a plurality of squeegees and a plurality primary squeegee action directions. A squeegee cleaning portion with a plurality of squeegees and a plurality of primary squeegee action directions is particularly well suited for cleaning irregular or contoured surfaces.

It is a further object of the present invention to provide a squeegee cleaning device and system with a squeegee portion that provides for a plurality directionally dependent primary squeegee directions. The squeegee cleaning device is particularly useful for cleaning applications where directionally dependent cleaning action is required or preferred.

It is a further object of the present invention to provide a squeegee cleaning device and system with a squeegee cleaning portion that has contoured squeegee segments. Contoured squeegee segments alter the mechanical properties and cleaning characteristics of the squeegee cleaning portion.

In is further object of the present invention to provide a squeegee cleaning device and system that has a squeegee portion with squeegee segments that protrude from a flexible squeegee support. The flexible squeegee support helps to ensure even cleaning pressures of the squeegee segments across a surface.

It is also an object of the present invention to provide a multi-functional squeegee cleaning device and system that has a squeegee portion with a plurality of squeegee directions and a sponge, a scouring or a brush cleaning portion. The squeegee cleaning device with a squeegee cleaning portion and a sponge, scouring or brush cleaning portion can be used to clean a variety of surfaces.

It is a further object of the present invention to provide a squeegee cleaning device and system with a squeegee cleaning portion that has a plurality of primary squeegee action directions and bristles, wherein the bristles extend substantially farther than the squeegee member. In addition to the cleaning action of the squeegee cleaning portion, the squeegee cleaning portion serves as a contour guide to ensure that the surface being cleaned is not damaged by excessive or abrasive cleaning action of the bristles.

It is a further object of the present invention to provide a hand-held squeegee cleaning device with a squeegee cleaning portion and a template holding portion, wherein the squeegee cleaning portion is an extendible/retractable or removable squeegee portion. The squeegee cleaning portion can be retracted or removed for application where the squeegee portion is not preferred. Further, in the embodiment where the squeegee cleaning portion is detachable, alternative squeegee portions may be used.

It is a further object of the present invention to provide a vacuum squeegee cleaning system with a squeegee cleaning portion, wherein the squeegee cleaning portion is attachable to a vacuum source and a vacuum is drawn through the squeegee cleaning portion.

It is a further object of the present invention to provide water squeegee cleaning system with a squeegee cleaning portion, wherein the squeegee cleaning portion is attachable to a water delivery source and water is delivered through the squeegee cleaning portion.

It is a further object of the present invention to provide rotary squeegee cleaning system with a squeegee cleaning portion, wherein the squeegee cleaning portion is attachable to a rotary device to provide a rotary squeegee cleaning action to a surface.

It is yet a further object of the present invention to provide an extendible rotary cleaning system with a contoured rotary squeegee cleaning portion. The contoured rotary squeegee cleaning portion is capable of being extending into a vessel or cavity and delivers a rotary cleaning action to inner walls of the vessel or cavity.

It is a further object of the present invention to provide a squeegee dentition cleaning system, wherein the system has a dentition squeegee cleaning section having a plurality of primary squeegee directions for removing plaque, stains and the like from the surfaces of teeth while also cleaning and massaging gum tissue without excessive abrasion. Further, the squeegee dentition cleaning system may be used with cleaning solutions that are delivered through pump device.

SUMMARY OF THE INVENTION

The cleaning device and system of the current invention has a squeegee cleaning portion configured with one or more elongated squeegee protruding from a squeegee support and extending in a plurality of directions. Because the squeegee segments extend in a plurality of directions from the squeegee support, the squeegee cleans a surface in a plurality of cleaning directions, which correspond to directions substantially normal to squeegee elongation directions. Linear squeegee devices known in the art contact a surface and clean the surface with a single linear back and forth direction. Since the squeegee cleaning device and system, of the current invention contact a surface and clean the surface with several non-parallel back and forth directions, the invention is coined as an efficient squeegee cleaning device and system.

The squeegee cleaning portion of the current invention has several alternative squeegee configurations, which provide for a plurality of squeegee cleaning directions. Useful squeegee configurations include, but are not limited to linear squeegee segments, continuous spiraling squeegees, circular squeegees and combinations thereof. Elongated squeegees are preferably made of soft malleable materials such as rubber, silicone and urethane. The surfaces of the squeegees are contoured or modified to alter their cleaning properties according the intended cleaning application.

The squeegee cleaning portion preferably has a contoured squeegee support that is compressible and allows protruding squeegees to readily conform to irregular surfaces. The contoured squeegee support may also be attached to a cleaning head, thus forming a cushion cavity between the contoured squeegee support and the cleaning head. The rigidity of the cushion cavity can be altered by filling the cushion cavity with a variety of materials including air, gels and silicones.

In one embodiment of the current invention, the squeegee cleaning portion also has a sponge section, scouring pad section or a brush section, which protrudes from the squeegee support. Alternatively, a sponge portion, scouring pad portion or a brush portion is attached to the edge of the squeegee support or positioned at the back side of the squeegee support to provide a multi-functional cleaning device.

In yet another embodiment of the current invention the squeegee cleaning portion is attachable to a vacuum source, wherein a vacuum is drawn through the squeegee cleaning portion or the squeegee cleaning portion is attachable to a water delivery source and water is delivered through the squeegee cleaning portion.

In yet other embodiments of the current invention, squeegee cleaning portions are capable of being attached to rotary devices and are configured to provide rotary cleaning action. These embodiments are useful for cleaning walls of containers, cleaning out pipes or plumbing but may also be used to clean flat surfaces such as floors. Further, rotary squeegee cleaning portions can be miniaturized to have medial applications.

Particular embodiments of the squeegee cleaning device and system, described herein, have household and industrial cleaning applications such as for cleaning dishes, porcelain and other hard surface. The invention also is particularly useful for cleaning dentition without causing deleterious abrasion to the surrounding gum tissue.

DETAILED DESCRIPTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

Figure 1A:
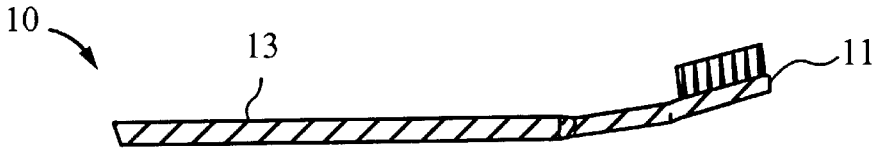
FIGS. 1*a–f* show several prior art cleaning devices.
Figure 1B:
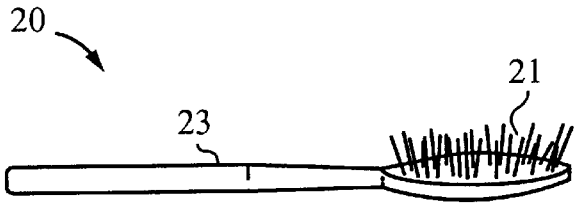
Figure 1C:
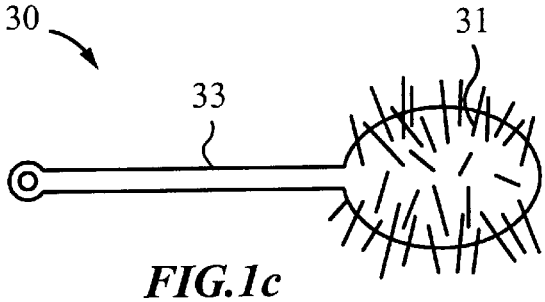
Figure 1D:
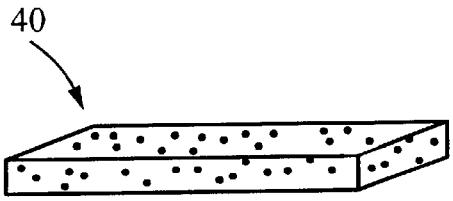
Figure 1E:
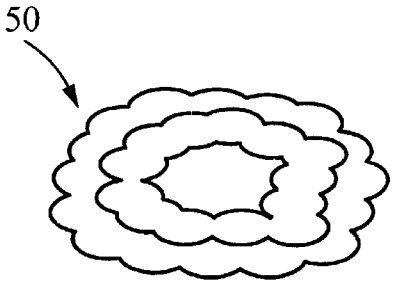
Figure 1F:
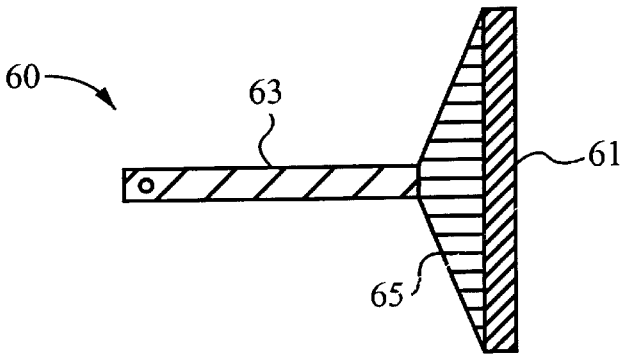
FIG.1f PRIOR ART

FIGS. 1*a–f* show several prior art cleaning devices. Many typical cleaning devices employ a brush portion or brush sections that are attached to a supporting structure with a handle. Examples include: a toothbrush 10 with a brush portion 11 supported by handle structure 13, as shown in FIG. 1*a;* a dish brush 20 with a brush portion 21 and a handle supporting structure 23, as shown in FIG. 1*b;* and a toilet brush 30 with a multi-directional brush portion 31 connected to a handle support structure 33, as shown in FIG. 1*c.* A sponge 40, illustrated in FIG. 1*d,* is typically made from a porous absorbent material. The sponge 40, as shown, is a rectangular sponge 40, be can be any shape. A sponge 40, like the brush devices described above, is often attached to a support structure with a handle (not shown). Sponge, herein refers to any absorbent material for cleaning surfaces, including woven cloths and the like. A scouring pad 50, as shown in FIG. 1*e,* is typically made from steel wool or other abrasive materials. Scouring pads are often attached to a surface of a sponge or connected to a brush device to provide for a multi-functional cleaning device (not shown). A typical squeegee device 60, is shown in FIG. 1*f.* The squeegee cleaning device 60 has a linear elongated squeegee member 61 that is held in a linear fashion by a supporting structure 65 equipped with a handle 63. The linear elongated squeegee 61 is generally made of a soft rubber material that provides for a squeegee cleaning action when the device 60 is dragged across a flat smooth surface. The squeegee device 60, illustrated herein, is generally used to clean windows.

Figure 2A:
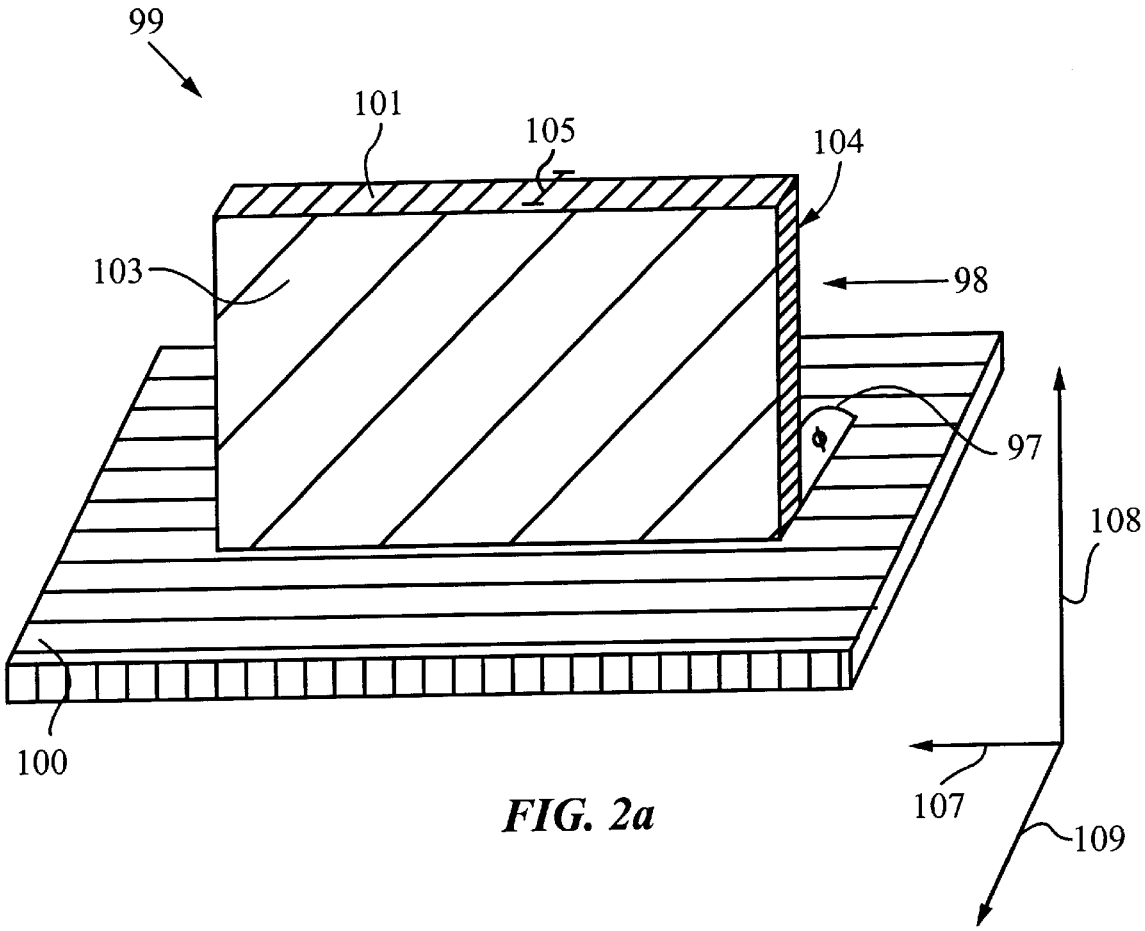
FIG. 2*a* illustrates a perspective view of an elongated linear squeegee protruding from a support.

FIG. 2*a* shows a perspective view of a squeegee structure 99 with a squeegee member 98 that protrudes from a support member 100 in a protruding direction 108. The squeegee member 98 has a protruding edge 101 that contacts a surface during a cleaning operation. The squeegee member 98 is elongated in an elongation direction 107 with two elongated squeegee walls 103/104. At any point on the surface of the squeegee walls 103/104, the squeegee member 98 has a squeegee wall thickness 105. The primary squeegee direction 109 is defined, herein, as a direction that is normal to the elongation direction 107. Thus, the linear elongated squeegee 98 provides for one primary squeegee direction, regardless of the protruding angle 97 or curvature of the squeegee wall in the protruding direction 108. For clarity and descriptive purpose, squeegee members and squeegee supports are usually described as separated elements. However, it is clear that squeegee members and squeegee supports may be a singular element and made of the same material. Further, the shapes of supports are not limited to circles or squares generally used, herein, for descriptive purposes; a squeegee support may take any shape or form that is reasonable for the application at hand.

Preferred embodiments of the current invention provides for a squeegee cleaning device and system with a squeegee cleaning portion that provides for at least two primary squeegee directions. Preferably the two primary squeegee directions are orthogonal and substantially normal to squeegee elongation directions. More preferably, the squeegee cleaning portion of the current invention provides for primary squeegee directions in all directions that are substantially normal to squeegee elongation directions. Most preferably, the squeegee cleaning portion of the current invention provides for a plurality of primary squeegee directions in all directions that are substantially normal to squeegee elongation directions. The squeegee configurations employed in the squeegee cleaning portion of the present invention do not need to protrude from a squeegee support member in a direction that is normal to the surface of the support member. In fact, for many cleaning applications it is preferred that the squeegee configurations have squeegee members that protrude in off normal directions from a squeegee support. Further, the squeegee cleaning action, referring to the number of squeegees or cleaning characteristics of squeegees, does not need to be equal in all primary squeegee directions. Several squeegee configurations used in the squeegee cleaning portion of the current invention provide for a plurality of primary squeegee directions where there are more or less squeegee protruding edges that contact a surface in one direction than in another. Also, the squeegee cleaning action can be modified in any direction by providing a squeegee configuration that has directionally varied squeegee thicknesses as described below.

Figure 2B:
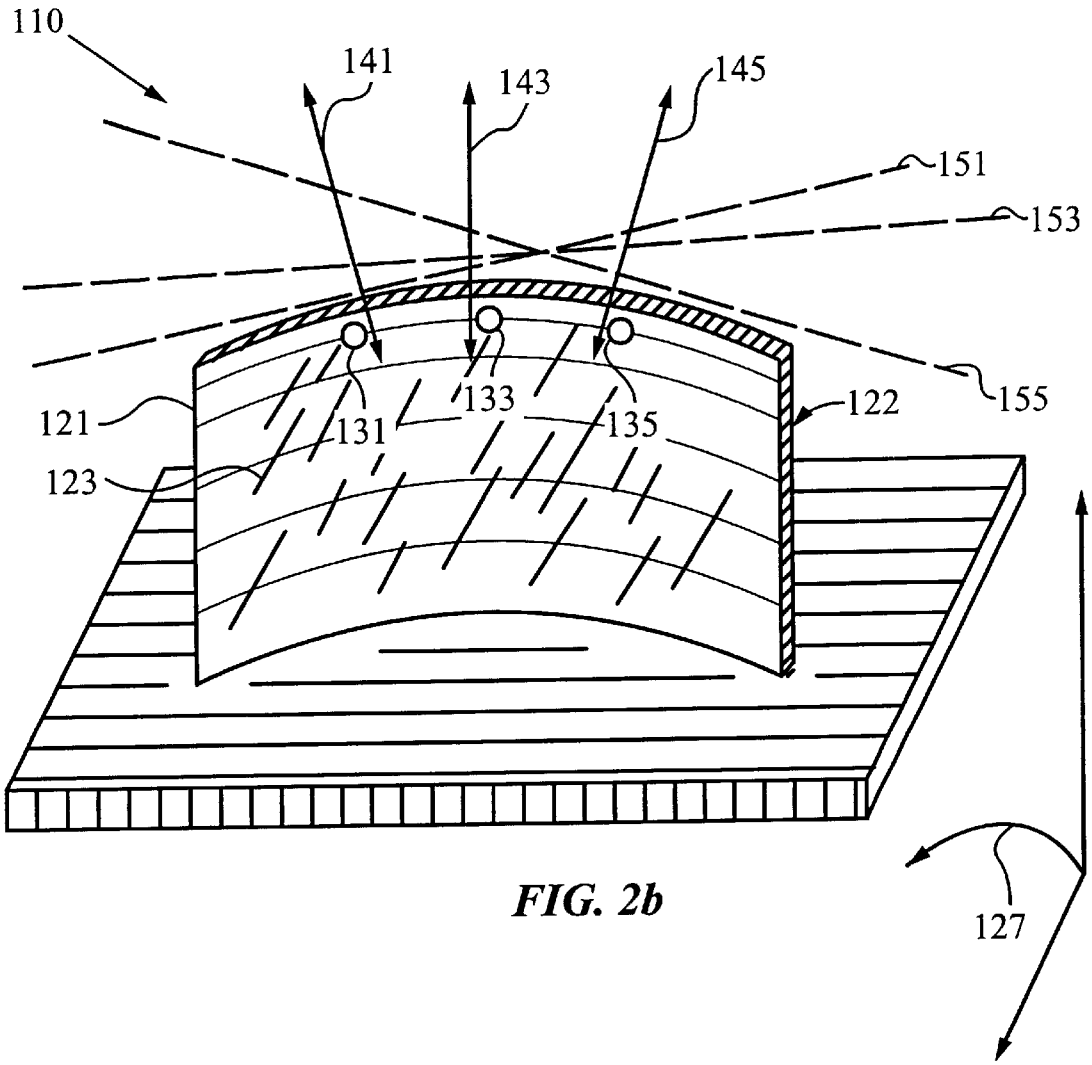
FIG. 2*b* illustrates a perspective view of an elongated curved squeegee member protruding from a support.

FIG. 2*b* illustrates a squeegee structure 110 with a curved squeegee member 121 that is curved in the elongation directions 127. Curved squeegee members, such as 121 are particularly useful in the current invention. Geometric considerations will reveal that each point on the curved squeegee wall 122/123 corresponds to a primary squeegee direction in the direction that is normal to a tangent line of the squeegee curvature. For example points 131, 133 and 135 have tangent lines of curvature 151, 153 and 155, respectively, and the corresponding primary squeegee directions 141, 143 and 145.

Figure 2C:
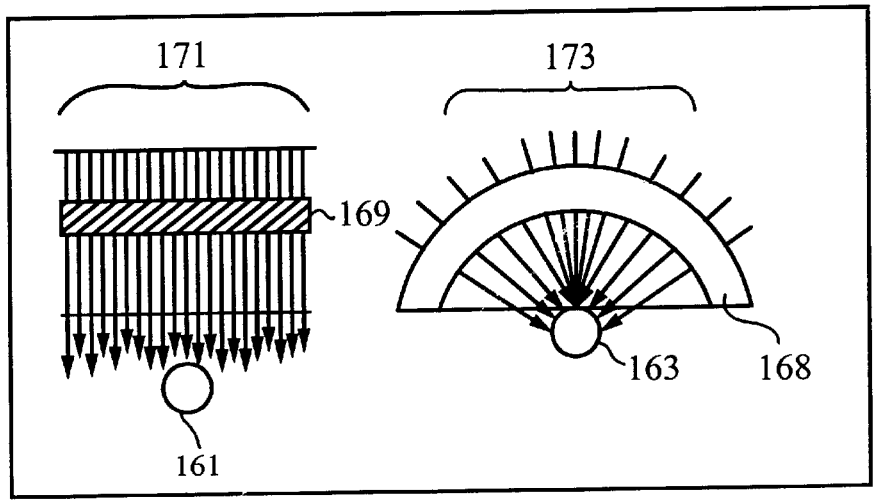
FIG. 2*c* compares the primary squeegee directions provided by the linear squeegee member of FIG. 2*a* and the curved squeegee member of FIG. 2*b*.

FIG. 2*b* compares the primary squeegee directions provided by the linear squeegee member of FIG. 2*a* and the curved squeegee member of FIG. 2*b.* It can be seen from FIG. 2*c,* that the curved squeegee member 168 can be moved in a set of directions 173 to contact a single point 163 with a primary squeegee action. While the linear squeegee 169 can only be moved in one direction 171 to contact a point 161 in a primary squeegee direction.

Figure 3A:
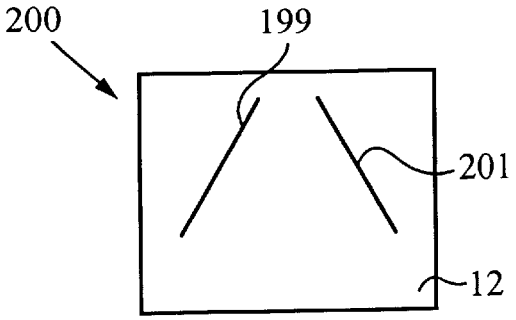
FIGS. 3*a–m* show a top perspective views of several squeegee configurations.
Figure 3B:
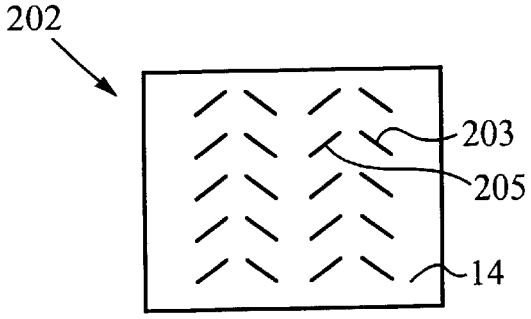
Figure 3C:
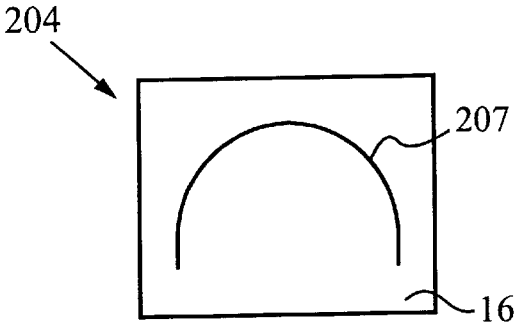
Figure 3D:
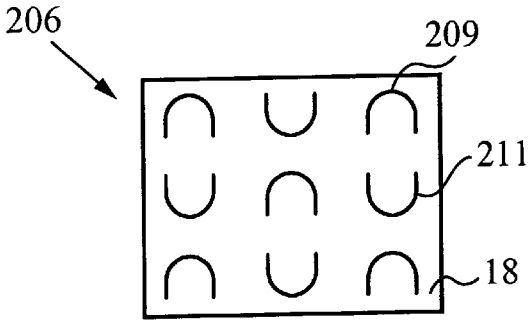
Figure 3E:
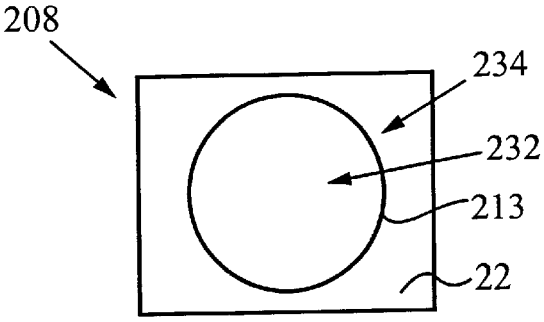
Figure 3F:
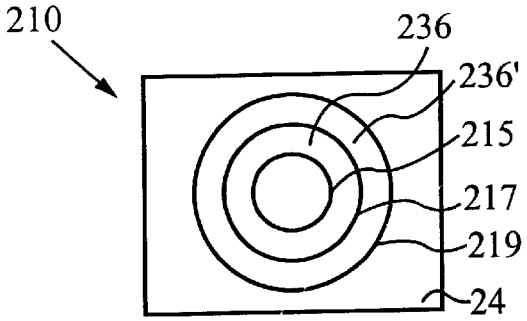
Figure 3G:
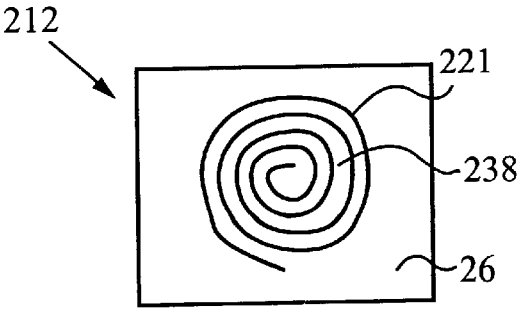
Figure 3H:
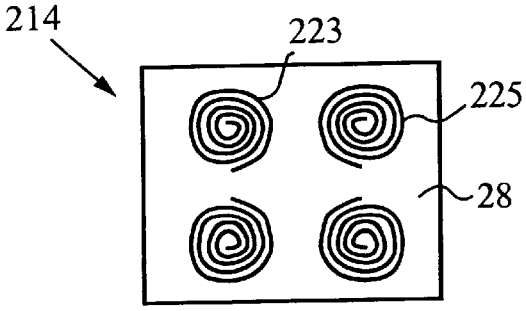
Figure 3I:
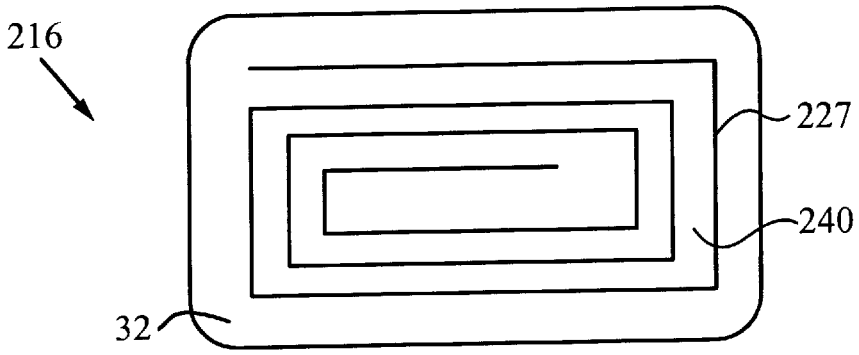
Figure 3J:
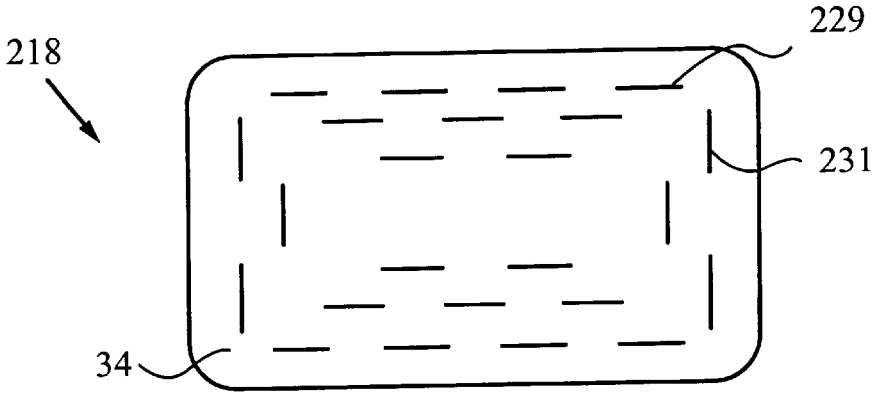
Figure 3K:
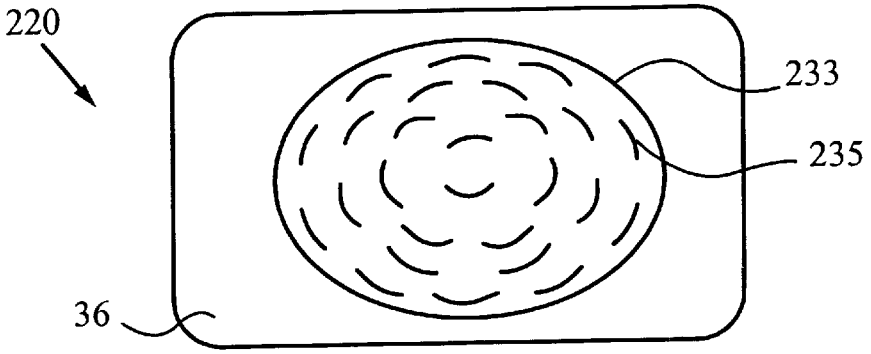
Figure 3L:
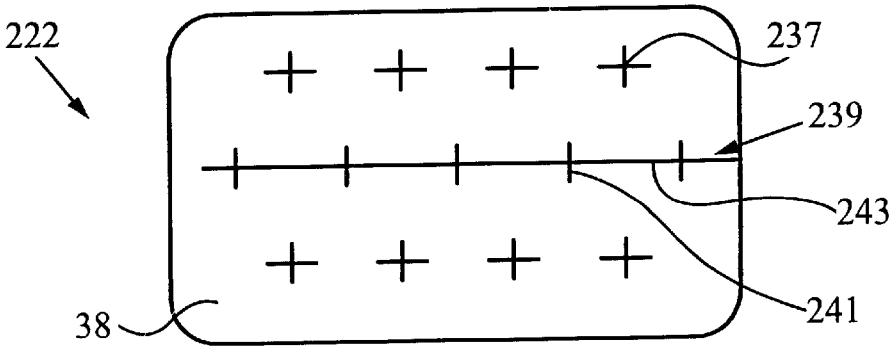
Figure 3M:
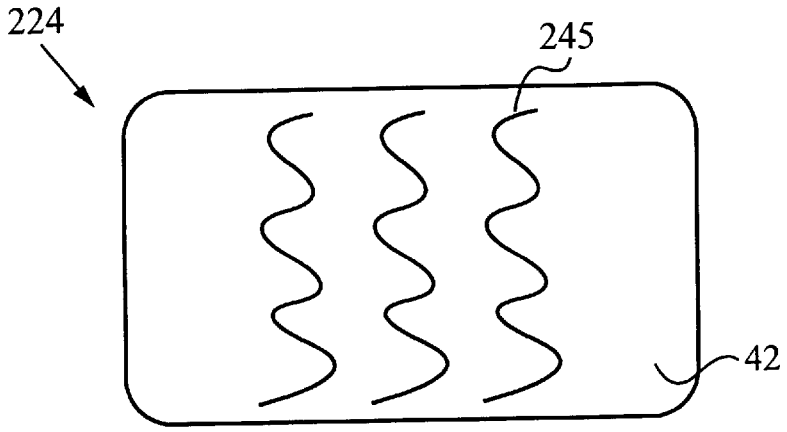

FIGS. 3*a–m* illustrate top perspective views of several alternative squeegee configurations that provide for a plurality of primary squeegee directions. FIG. 3*a* shows a squeegee configuration 200 with two elongated squeegee members 199/201 that protrude from a support member 12. Because the squeegee members 199/201 are positioned in an angled fashion, the squeegee configuration 200 provides for two primary squeegee directions that are substantially normal to the two corresponding elongation directions of the squeegee members 199 and 201. FIG. 3*b* shows a squeegee configurations 202 with a plurality of linear squeegee segment members 203/205 positioned at alternating angles and protruding from several positions of a support member 14. FIG. 3*c* illustrates a squeegee configuration 204 with a curved elongated squeegee member 207 that protrudes from a support member 16. The curved or cupped squeegee configuration 204 provides for primary squeegee directions in all directions of a plane substantially parallel to the squeegee member 207 elongation directions. However, the squeegee configuration 204 does not provide for equal squeegee actions in all directions, because the squeegee member 207 will squeegee a surface twice each time the squeegee member 207 is moved with a sideways cleaning motion, but will squeegee a surface once for each up or down cleaning motion. Thus, the squeegee configuration 204 provides for a plurality of directionally dependent primary squeegee directions. FIG. 3*d* illustrates a squeegee configurations 206 with several cupped squeegee members 209/211 that protrude from a support member 18 with the squeegee members 209 and 211 cupped in opposite directions. FIG. 3*e* shows a squeegee configuration 208 with a continuous circular squeegee member 213 protruding from a support member 22. The continuous circular squeegee member 213 forms an inner squeegee region 232 and an outer squeegee region 234. Like the cupped squeegee configuration 204, the squeegee configuration 208 provides for primary squeegee directions in all directions of a plane substantially parallel to the elongation directions of the circular squeegee member 213. However, the circular squeegee configuration 208 provides for a plurality directionally independent primary squeegee directions. FIG. 3*f* illustrates a squeegee configuration 210 with several continuous circular squeegee members 215, 217 and 219 protruding from a support member 24 that form a concentric set of squeegees with circular channels 236 and 236'. The set of concentric continuous circular squeegee members provide for a plurality of primary squeegee directions in all directions of a plane substantially normal to the squeegee elongation directions. FIG. 3*g* shows a squeegee configuration 212 with a spiraling squeegee member 221 protruding from a squeegee support member 26. The spiraling squeegee member 221 forms a spiraling squeegee channel 238 and provides for a plurality of primary squeegee directions in all directions of a plane substantially normal to the squeegee elongation directions. FIG. 3*h* shows a squeegee configuration 214 with a plurality of spiraling squeegee members 223 and 225 protruding from a squeegee support member 28 to provide a plurality of primary squeegee directions in all directions of a plane substantially normal to the squeegee elongation directions. FIG. 3*i* also shows a squeegee configuration 216 with a spiraling squeegee member 227 protruding from a squeegee support member 32. The squeegee member 227 spirals in a substantially rectangular fashion and forms a rectangular-like squeegee channel 240. The squeegee configuration 216 provides for directionally dependent squeegee action, wherein a diagonal cleaning motion will give a different squeegee action than a sideways or up and down cleaning motion. FIG. 3*j* and FIG. 3*k* illustrated squeegee configurations 218 and 220 that have squeegee segments protruding from a squeegee support members 34 and 36, respectively, where the squeegee segments are positioned at alternating angles on the squeegee support members 34/36. FIG. 3*j* shows linear squeegee segments 229 and 231 positioned at near to right angles relative to each other and forming a rectangular segmented squeegee configuration 218. FIG. 3*k* shows squeegee configuration 220 comprising curved squeegee segments 235 that are positioned to from the circular segmented squeegee configurations 220, wherein the squeegee segments 235 are positioned within a inner squeegee region of a larger circular continuous squeegee member 233. FIG. 3*l* and FIG. 3*m* illustrate yet other squeegee configurations 222 and 224 that have squeegee members protruding from a squeegee support members 38 and 42. In FIG. 3*l* the squeegee configuration 222 has cross-type of squeegee segments 237. The configuration 222 also has squeegee member 239 with a major squeegee segment 243 crossed with smaller intersecting squeegee segments 241 that are positioned at near to right angles relative to the major squeegee segment 243. In FIG. 3*m* the squeegee configuration 224 has squiggling squeegee members 245 protruding from a squeegee support member 42 to provide several primary squeegee directions.

Figure 4A:
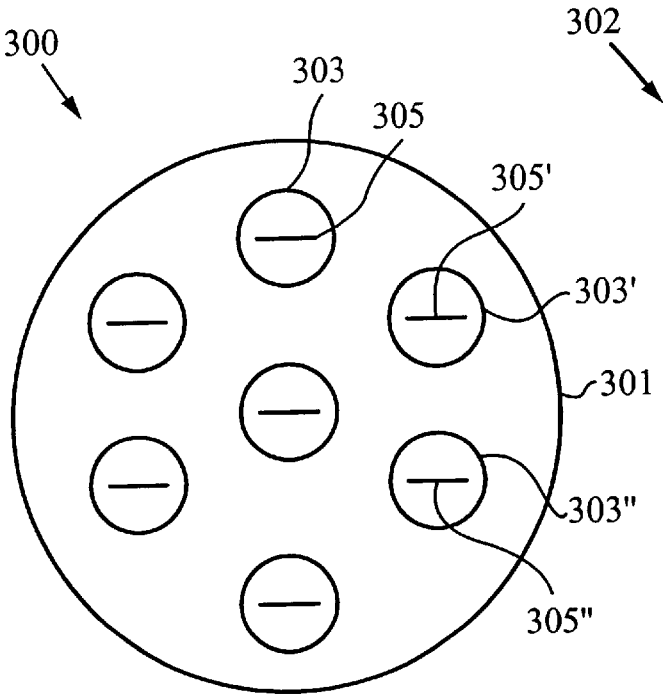
FIG. 4*a–d* show several squeegee configurations that exhibit directionally dependent primary squeegee directions.
Figure 4B:
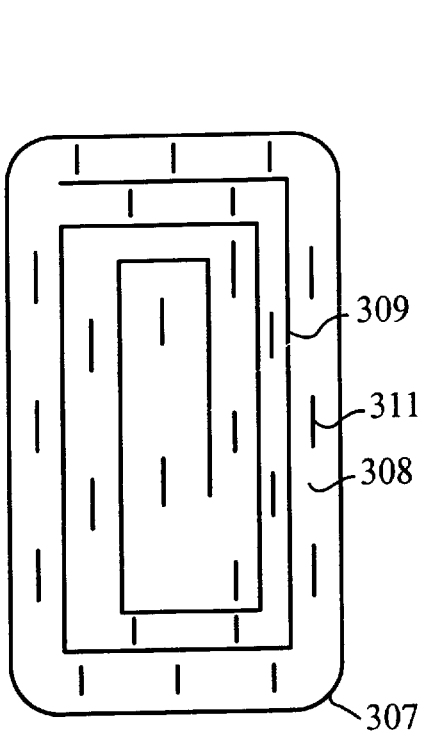
Figure 4C:
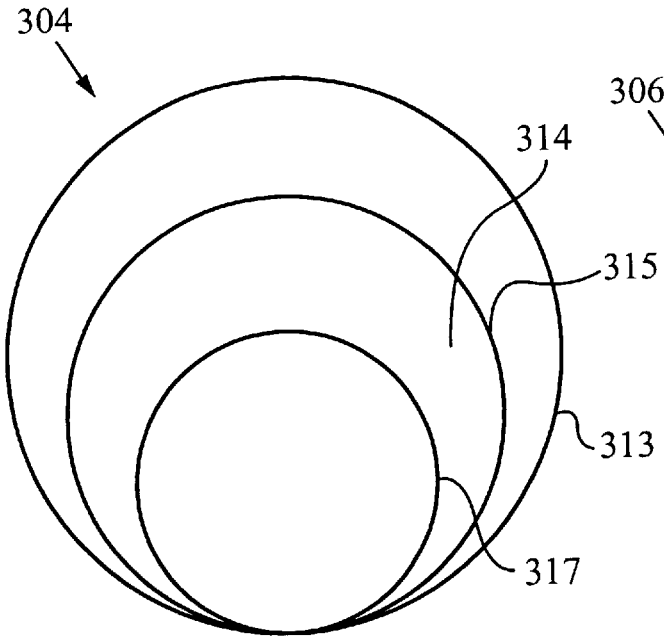
Figure 4D:
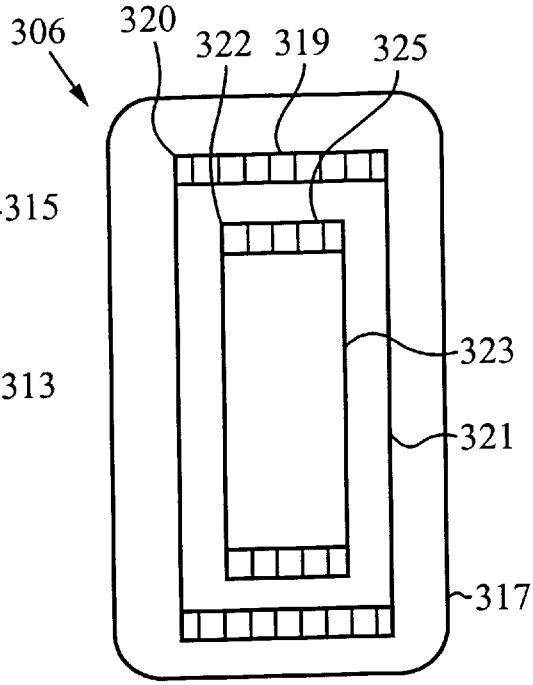

FIGS. 4*a*–*d* illustrate several squeegee configurations that, in addition to providing for primary squeegee action directions in all directions of a plane substantially normal to protruding directions of squeegee members, also provide for directionally dependent primary squeegee actions. FIG. 4*a* shows a squeegee configuration 300 with several circular squeegee members 303, 303' and 303" protruding from a circular squeegee support member 301. Within, the inner squeegee region of the circular squeegee members 303, 303' and 303" there are linear squeegee segments 305, 305' and 305", respectively. The linear squeegee segments 305, 305' and 305" only provide for primary squeegee actions when the squeegee configuration 300 is moved on a surface with an upward or a downward cleaning motion. The linear squeegee segments 305, 305' and 305" do not, however, provide primary squeegee actions when the squeegee configuration 300 is moved on a surface with a sideways cleaning motion. FIG. 4*b* illustrates an alternative squeegee configuration 302 that provides for directionally dependent primary squeegee action. Linear squeegee segments 311 are positioned in the squeegee channel 308 of a spiraling rectangular squeegee member 309 that protrudes from a squeegee support member 307. In this example, the linear segments 311 only provide for additional primary squeegee actions when the squeegee configuration 302 is moved on a surface with a sideways cleaning motion. FIG. 4*c* shows a squeegee configuration 304 with two non-concentrically positioned circular squeegee members 315 and 317 protruding from a circular squeegee support member 304. In the squeegee configurations 304, it is the non-concentric channel spacing 314 between the squeegee members 315 and 317 that provides for directionally dependent primary squeegee actions. FIG. 4*d* shows a different squeegee configuration 306 that provides for directionally dependent squeegee action. The squeegee configuration 306 comprises two rectangular squeegee members 320 and 322. The longer squeegee walls 321 and 323 of the rectangular squeegees, 320 and 322, are thin while the shorter squeegee walls, 319 and 325, are thick. In this way the primary squeegee action is made to be different when the squeegee configuration 306 is moved on a surface with a sideways cleaning motion rather than when it is moved on a surface with an upward or a downward cleaning motion. It is clear that there are many alternative squeegee configuration that can provide for directionally dependent squeegee actions by variations of squeegee geometries, squeegee configurations, squeegee thicknesses, squeegee materials and combinations thereof.

Figure 5A:
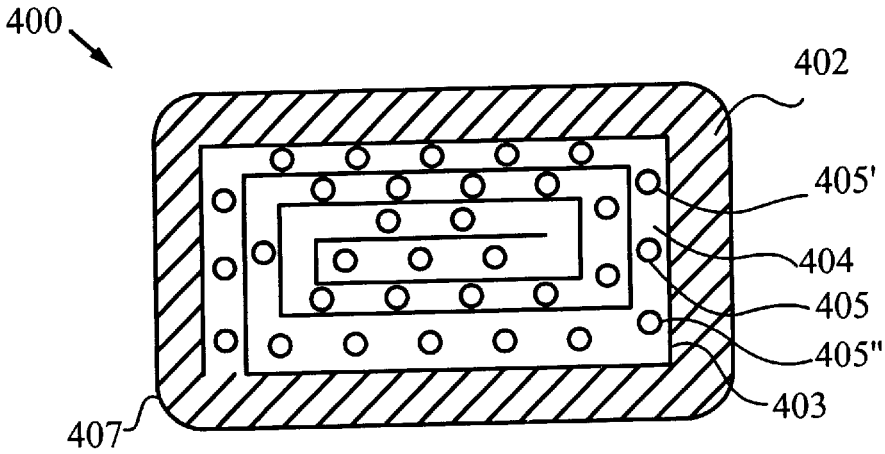
FIGS. 5*a–d* show several squeegee configurations with squeegee sections and sponge, scouring pad or bristle sections.
Figure 5B:
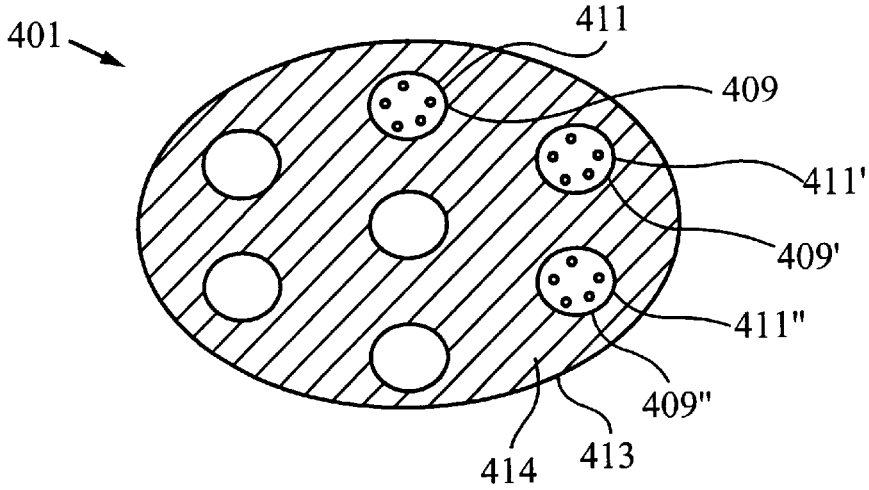
Figure 5C:
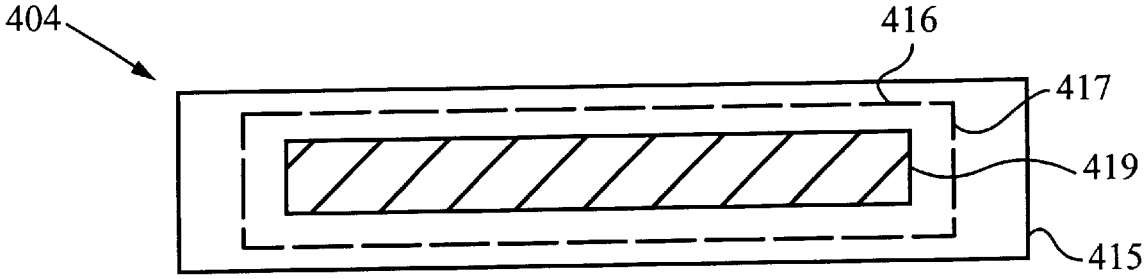
Figure 5D:
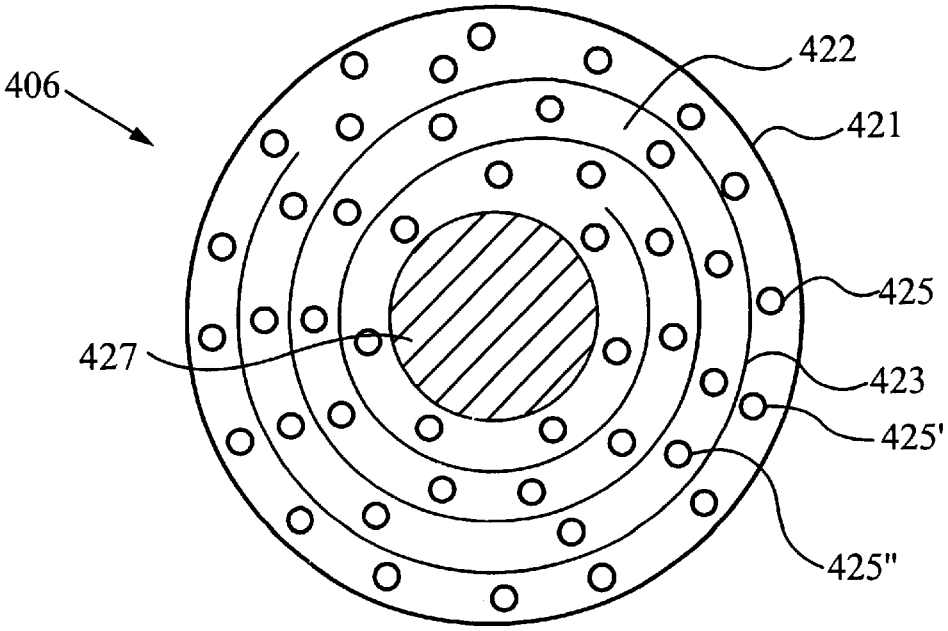

FIGS. 5*a*–*d* show top perspective views of several cleaning portions configured with squeegee sections and brush sections, sponge sections scouring pad sections, medium ports or combination thereof. FIG. 5*a* shows a cleaning portion 400 with a spiraling rectangular squeegee 403 protruding from a rectangular support member 407. In the rectangular-like squeegee channel 404 there are several brush sections 405, 405' and 405" protruding from the support member. Around the outside of the spiraling rectangular squeegee member 403 there is a sponge section 402 attached to the support member. The cleaning section configuration 400 provides for the cleaning characteristics of a squeegee, a brush and a sponge. FIG. 5*b* illustrates a cleaning portion configuration 401 with squeegee members 409, 409' and 409" protruding from a circular support member 413. Within the inner squeegee region of the circular squeegee members 409, 409' and 409" there are bristles sections 411, 411' and 411". Attached to the support member 413 and positioned at the outer squeegee regions of the circular members 409, 409' and 409" there is a scouring material 414. The cleaning section configuration 401 provides for the cleaning characteristics of a squeegee, a brush and a scouring pad. FIG. 5*c* shows a cleaning portion configuration 404 comprising of squeegee segments 416 and 417 protruding from a rectangular support member 415 and forming a segmented rectangular squeegee configuration. Within the segmented rectangular squeegee configuration, there is a substantially rectangular brush section 419 protruding from the support member 415. This cleaning portion configuration is useful for cleaning applications where brush and squeegee cleaning characteristics are required. FIG. 5*d* illustrates a cleaning portion configuration 406 with a spiraling squeegee member 423 protruding from a circular support member 421 and forming a spiral channel 422. There are several medium ports 425, 425' and 425" positioned at the parameter of the spiraling squeegee 423 and within the spiraling channel 422. The medium ports 425, 425' and 425" provide a means for directing a medium to a surface during a cleaning operation or for drawing a vacuum near a surface during a vacuum cleaning operation of the surface. The cleaning portion configuration 406 further includes a brush section 427 attached substantially central to the support member 421. The cleaning portion configuration 406 is particularly useful where a cleaning medium such water is required or where vacuum convection is needed. The cleaning portion configuration 406 also may be attached to a rotary device to provide a rotary cleaning action to a surface during a cleaning operation. It is clear that there are several variations of cleaning portion configurations that will provide for multiple cleaning characteristics that are within the scope of the invention.

Figure 6A:
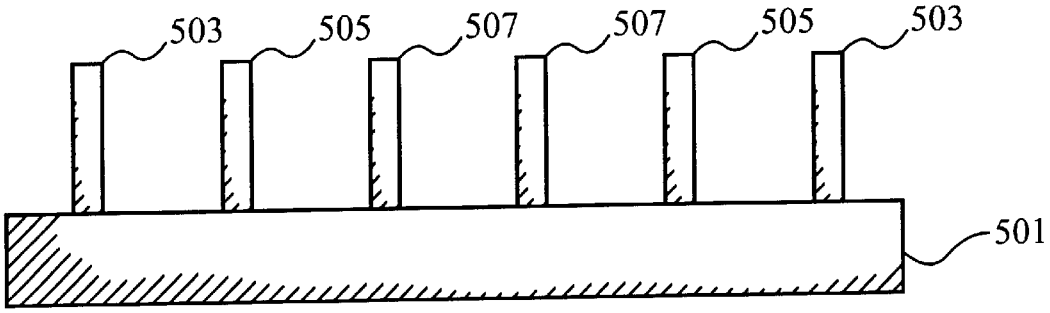
FIG. 6*a* illustrates a cross-sectional view of a squeegee section with several circular squeegee members protruding from a squeegee support.
Figure 6B:
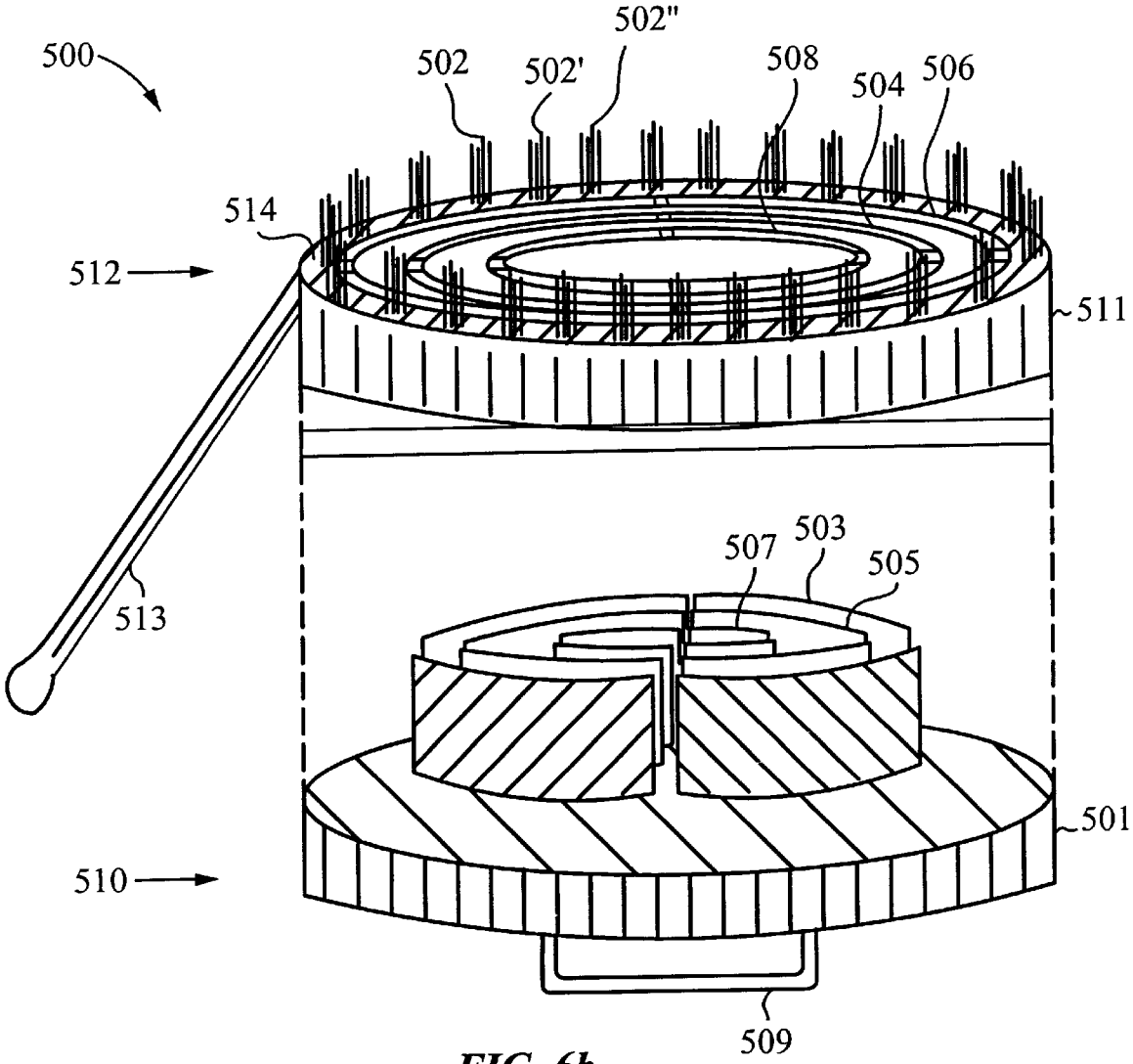
FIG. 6*b* illustrates a squeegee cleaning device with a detachable squeegee section.

FIG. 6*a* illustrates a cross sectional view of a squeegee support 501 with curved sectional squeegee members 503, 505 and 507. FIG. 6*b* shows a cleaning device 500 with a detachable squeegee portion 510 and a template portion 512. The detachable squeegee portion 510 has a handle 509 for inserting squeegee portion 510 in and removing the squeegee portion 508 from the template portion 512. The template portion has a receiving section 511, with channeled slots 506, 504 and 508. With the squeegee portion in an inserted position and engaged, the squeegee members 503, 505 and 507 protrude through the channeled slots 506, 504 and 508, respectively. On the surface 514 of the template receiving section 511, there are bristle sections 502, 502' and 502". Preferably the template section 512 has a handle 513 for providing extended cleaning capabilities. The cleaning device 500 shown, and its obvious variants, have several advantages. The squeegee portion 510 and the template section 512 can be used for cleaning surfaces independently. Several squeegee sections (not shown) with similar squeegee configurations, but with different cleaning properties, can be used in place of the squeegee portion 510 shown. Additionally, the squeegee portion 510 is self-cleaned when it is removed from the template portion 512.

Figure 7A:
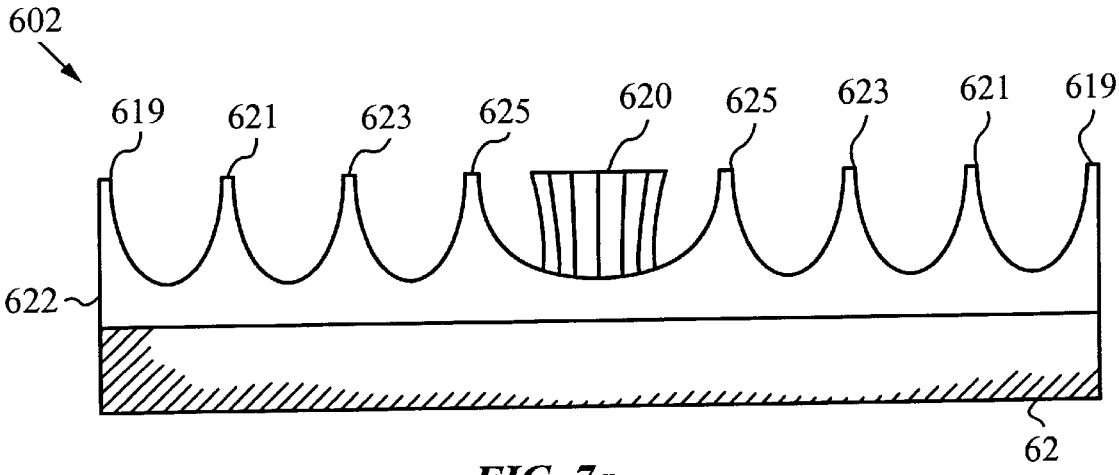
FIGS. 7*a–d* show cross-sectional views of several squeegee portions with near circular concentric squeegees walls protruding from a single squeegee member and several variations thereof.
Figure 7B:
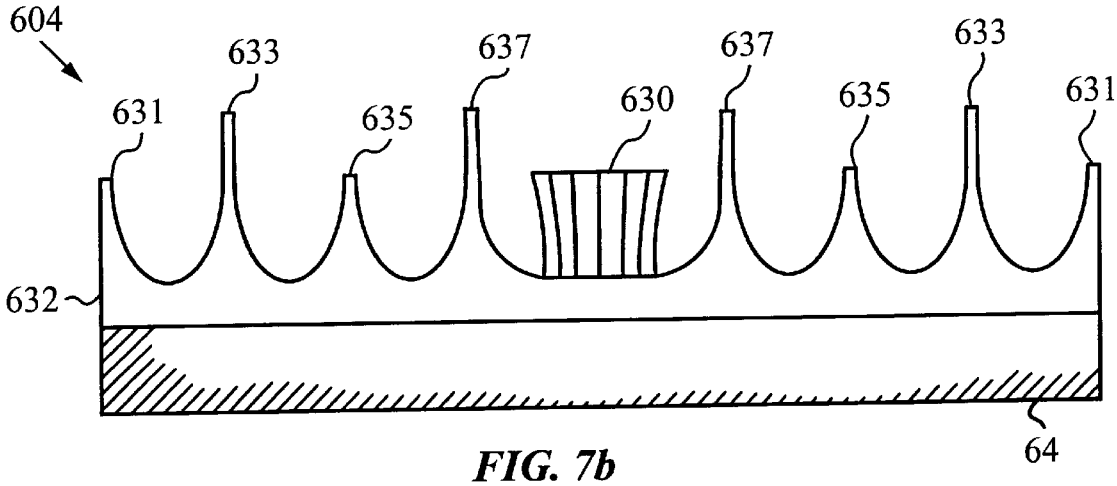
Figure 7C:
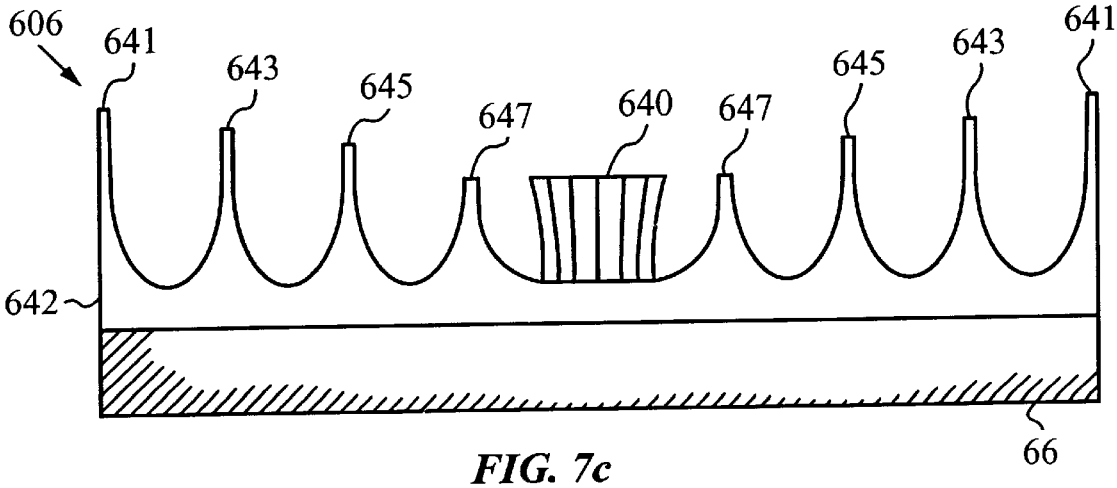
Figure 7D:
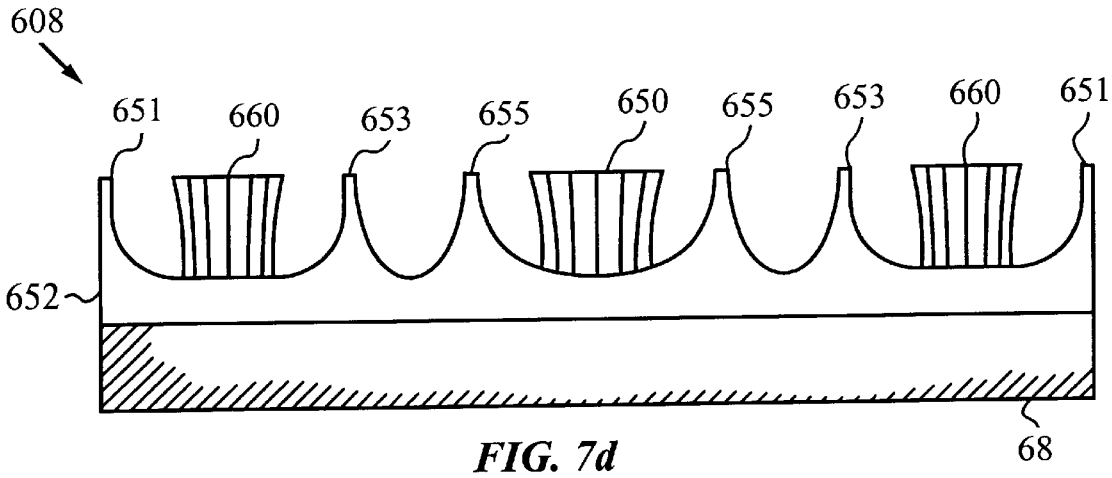

FIGS. 7*a–d* show cross-sectional views of several squeegee cleaning portion configurations with squeegee sections having substantially circular squeegee edges that protrude from squeegee support members. For example, FIG. 7*a* shows a cross-sectional view of a squeegee cleaning portion 602 with a squeegee member 622 attached to a support member 62. The squeegee member has four substantially circular protruding squeegee edges 619, 621, 622 and 625. Positioned substantially in the center of, and attached to the squeegee member 622, is a brush section 620. FIG. 7*b* shows cross sectional view of a squeegee cleaning portion 604 with a squeegee member 632 attached to a support member 64. The squeegee member 632 has four substantially circular protruding squeegee edges 631, 633, 635 and 637. The protruding squeegee edges protrude in an alternating fashion with squeegee edges 633 and 637 protruding farther than squeegee edges 631 and 635. Positioned substantially in the center of the squeegee member 632, and attached to the squeegee member 632 is a brush section 630. FIG. 7*c* shows cross-sectional view of a squeegee cleaning portion 606 with a squeegee member 642 attached to a support member 66. The squeegee member 642 has four substantially circular protruding squeegee edges 641, 643, 645 and 647. The protruding squeegee edges protrude in a cascade fashion with the squeegee edge 641 protruding farthest and the squeegee edge 647 protruding the least. Positioned substantially in the center of the squeegee member 642, and attached to the squeegee member 642 is a brush section 640. FIG. 7*d* shows cross-sectional view of a squeegee cleaning portion 608 with a squeegee member 652 attached to a support member 68. The squeegee member 652 has three substantially circular protruding squeegee edges 651, 653, and 655. The protruding squeegee edges are spatially displaced such that the distance between protruding squeegee edges 651 and 653 is greater than the distance between protruding squeegee edges 653 and 655. In this configuration there are two brush section 650 and 660. The brush section 650 is positioned substantially in the center squeegee member 652 while the brush section 660 is a continuous circular brush section that positioned in the circular channel defined by the protruding squeegee edges 651 and 653.

Figure 8A:
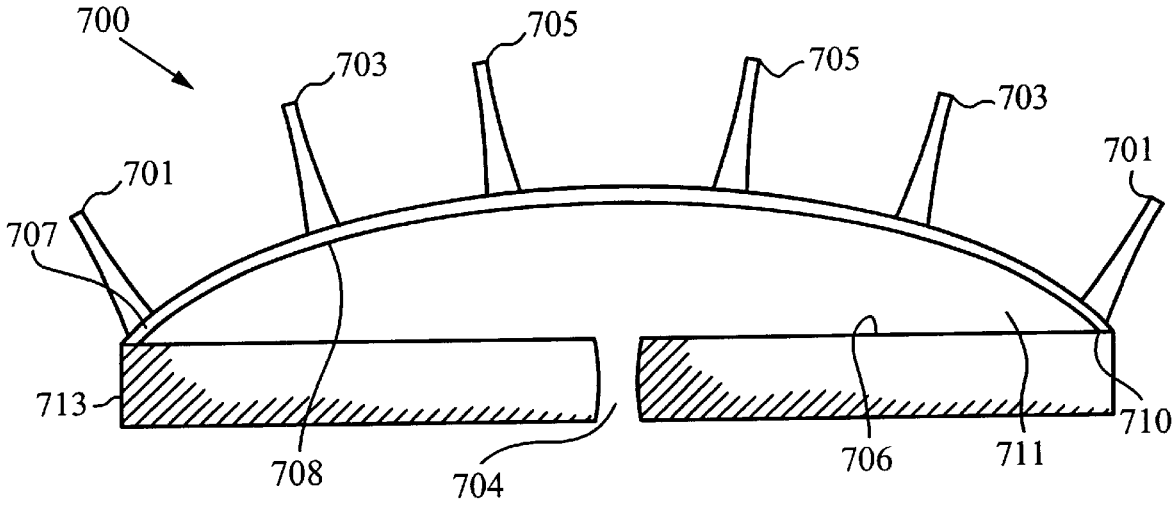
FIGS. 8*a–b* illustrate squeegee cleaning devices of the current invention with contoured squeegee support members attached to cleaning heads.
Figure 8B:
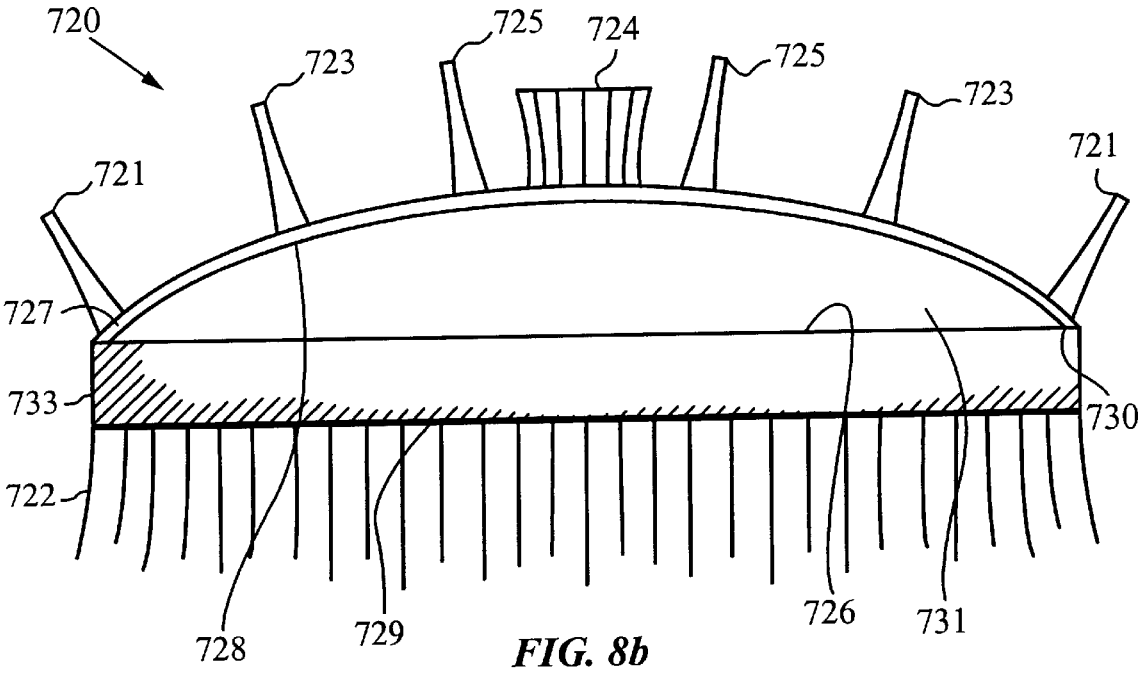

FIGS. 8*a–b* illustrate cross sectional views of cleaning devices with circular squeegee members protruding from curved contoured squeegee support members. FIG. 8*a* shows a cross sectional view of a cleaning device 700 with circular squeegee members 701, 703 and 705 protruding from a curved contoured squeegee support 707 to form a convex contact surface with the protruding edges of the squeegee members 701, 703 and 705. The edge 710 of the squeegee support 707 is attached to a cleaning head 713 such that the concave back surface of the squeegee support 708 and a top surface of the cleaning head 706 form a cushion cavity 711. The cushion cavity 711 allows the convex contact surface to conform to an irregular surfaces during cleaning operations. In a preferred embodiment, the cushion cavity 711 is filled with air that is allowed to escape through an orifice 704 in the cleaning head 713 when pressure is applied to the squeegee members 701, 703 and 705. FIG. 8*b* shows a cleaning device 720 with circular squeegee members 721, 723 and 725 protruding from a curved contoured squeegee support 727 to form a convex contact surface with the protruding edges of the squeegee members 721, 723 and 725. The edge 730 of the squeegee support 727 is attached to a cleaning head 733 such that the concave back surface of the squeegee support 728 and a top surface of the cleaning head 726 form a cushion cavity 731. Filling the cushion cavity 731 with a liquid or a gel, such as silicone gel can modify the rigidity of the cushion cavity 731. The cleaning device 720 has a brush section 724 attached substantially in the center of the contoured squeegee support 727 and a brush portion 722 attached to the back surface of the cleaning head 729. While it is preferred that the squeegee members are circular, any of the numerous squeegee configurations described, herein, can be attached to a contoured squeegee support. Squeegee cleaning devices such as those described in FIGS. 8*a–b,* and variations thereof, are especially useful for cleaning irregular surfaces and surfaces where excessive pressure of a cleaning device can cause damage to the surface.

Figure 9:
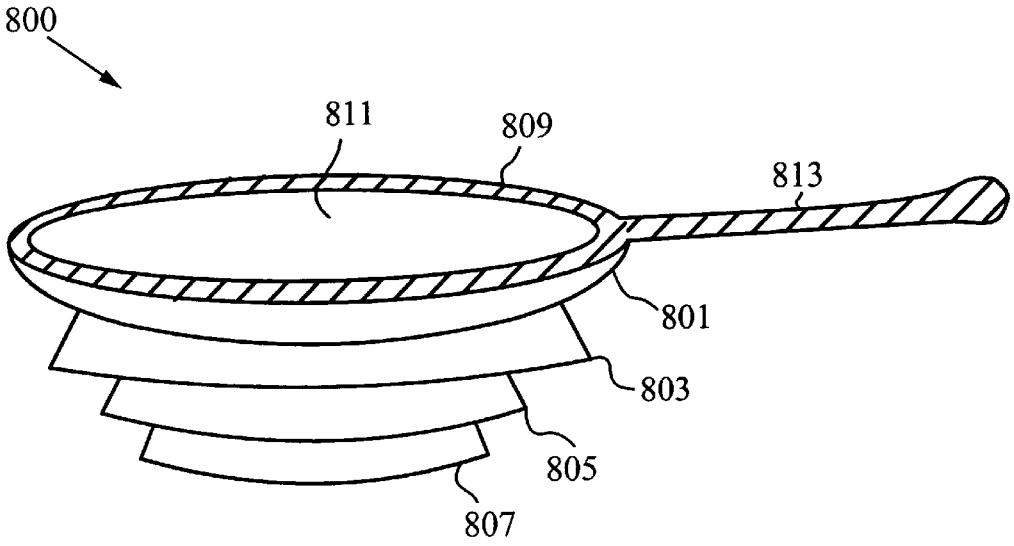
FIG. 9 illustrates a cleaning device with a contoured squeegee support member and a front convex surface attached to a wire-like supporting device with a handle.

FIG. 9 illustrates a squeegee cleaning device 800 with three substantially circular squeegee members 803, 805 and 807 protruding from a flexible contoured squeegee support member 801. An edge of the squeegee support member 801 is attached to a wire like support 809 that is equipped with a handle 813. The convex back surface of the contoured squeegee member 811 is capable of being deformed when pressure is applied to the squeegee members 803, 805 and 807. Thus the squeegee cleaning device 800 readily conforms to the contoured or irregular surfaces during a cleaning operation.

Figure 10A:
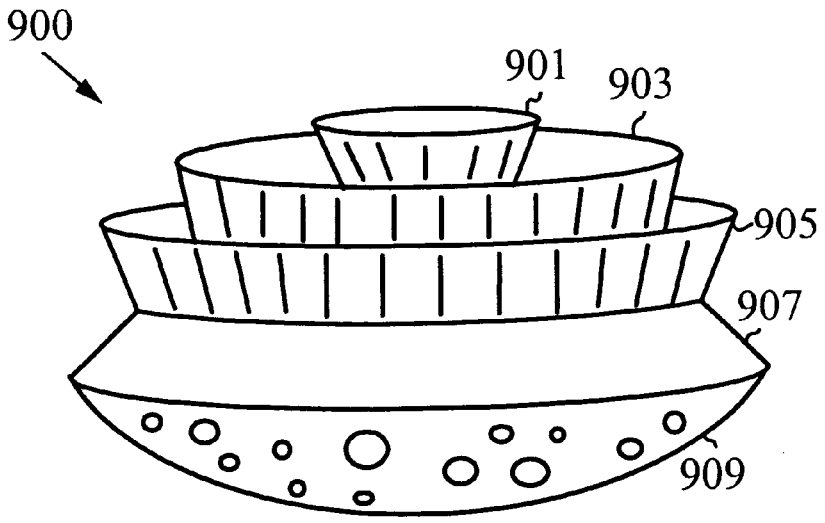
FIGS. 10*a–b* show two configurations of hand-held squeegee cleaning devices of the current invention with sponge portions attached.
Figure 10B:
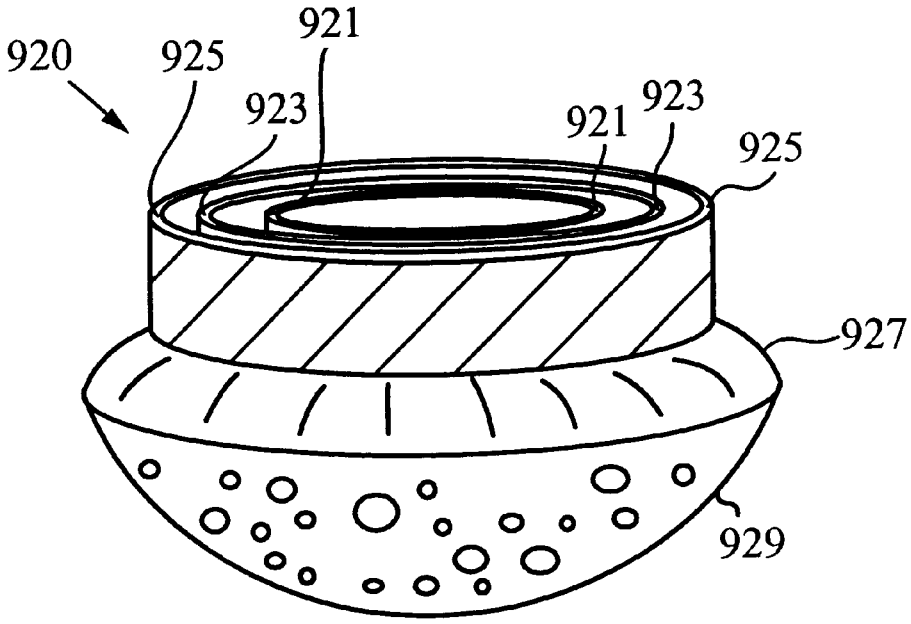

FIGS. 10*a–b* illustrate two hand held squeegee cleaning devices with circular squeegees protruding from contoured squeegee support members and with sponge portions attached. FIG. 10*a* shows a cleaning device 900 with substantially circular squeegees members 901, 903 and 905 protruding in an angular fashion from a convex surface of a contoured squeegee support 907 to form a convex cleaning contact surface with the protruding edges of the squeegee members 901, 903 and 905. On a back surface of the squeegee support 907 a sponge portion 909 is attached. The cleaning device 900 is particularly useful for cleaning dishes or for other applications where a compact hand held cleaning device is preferred. FIG. 10*b* shows a squeegee cleaning device 920 with substantially circular squeegees members 921, 923 and 925 protruding from a convex surface of a contoured squeegee support 927 to form a substantially planar cleaning contact surface with the protruding edges of the squeegee members 921, 923 and 925. On a back surface of the squeegee support 927 a sponge portion 929 is attached. The planar cleaning contact surface of the squeegee cleaning device 920 formed by the circular squeegee members 921, 923 and 925 serves as a squeegee cleaning portion and as a convenient draining platform for resting and drying the sponge portion 929 after use. While several specific embodiments of the current invention illustrate cleaning devices with circular, spiraling and other continuous or elongated squeegee members, squeegee cleaning devices with several elongated linear squeegee segment members are preferred for many cleaning applications.

Figure 11A:
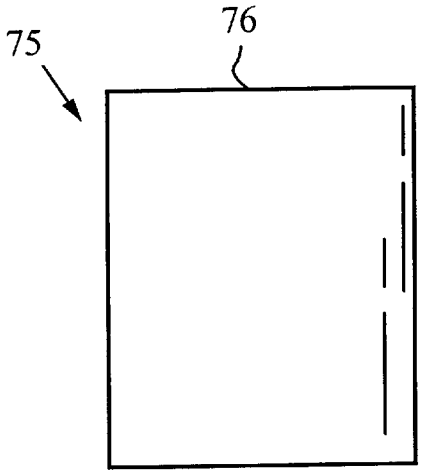
FIGS. 11*a–f* show several squeegee segments with contoured protruding edges used in the cleaning device and system of the current invention.
Figure 11B:
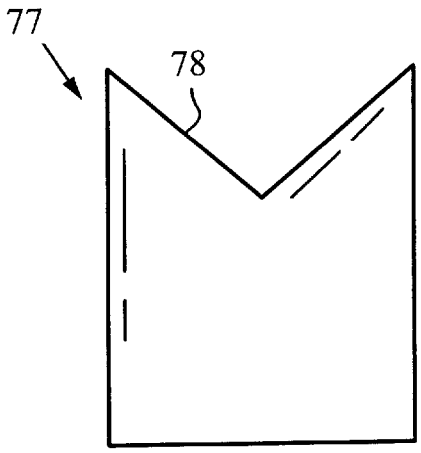
Figure 11C:
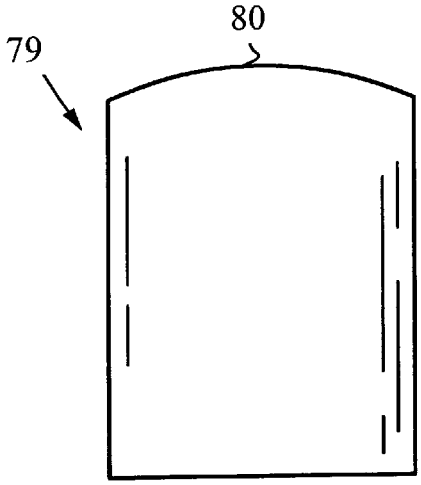
Figure 11D:
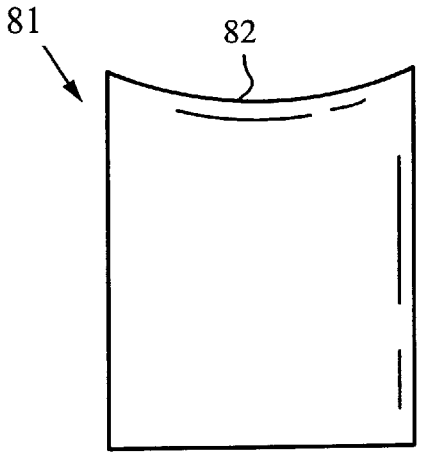
Figure 11E:
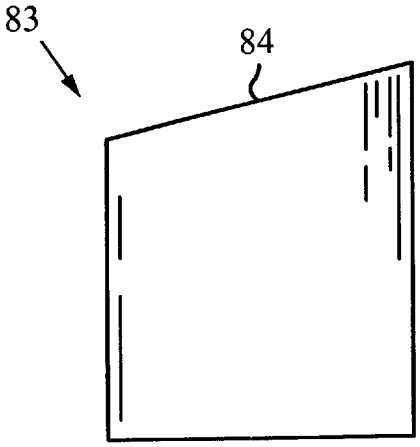
Figure 11F:
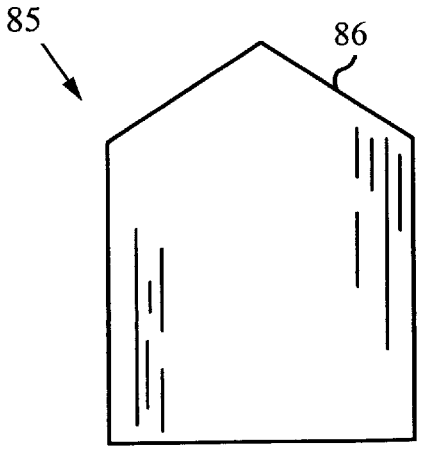

FIG. 11*a* shows a squeegee segment 75 with a planar protruding edge 76. FIG. 11*b–f* illustrate several squeegee segments with contoured protruding squeegee edges. FIG. 11*b* illustrates a squeegee segment 77 with a V-shaped indented protruding edge 78; FIG. 11*c* illustrates a squeegee segment 79 with a curve convex contoured protruding edge 80; FIG. 11*d* shows a squeegee segment 81 with a concave contoured protruding squeegee edge 82; FIG. 11*e* shows a squeegee segment 83 with a diagonally contoured protruding squeegee edge 84; and FIG. 11*f* shows a squeegee segment 85 with a pointed protruding edge 86. Squeegee cleaning devices that have squeegee members with contoured segments, such as those illustrated in FIGS. 11*b–f,* provide a harsher cleaning action than a similar squeegee cleaning devices with squeegee members with planar squeegee segments, such as illustrated in FIG. 11*a*.

Figure 12A:
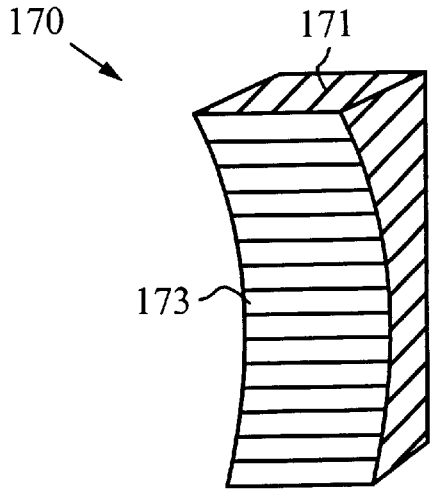
FIGS. 12*a–d* show several squeegee segments with contoured squeegee walls used in the cleaning device and system of the current invention.
Figure 12B:
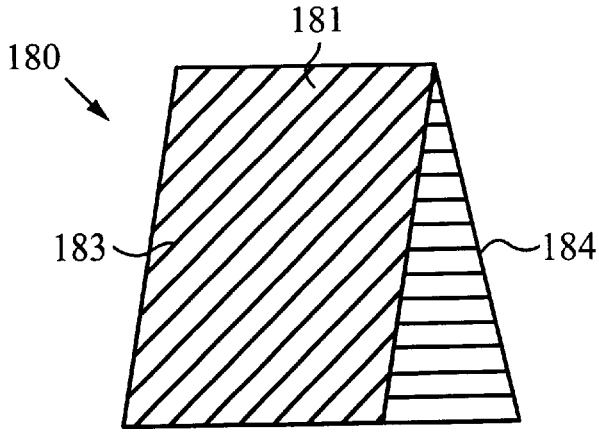
Figure 12C:
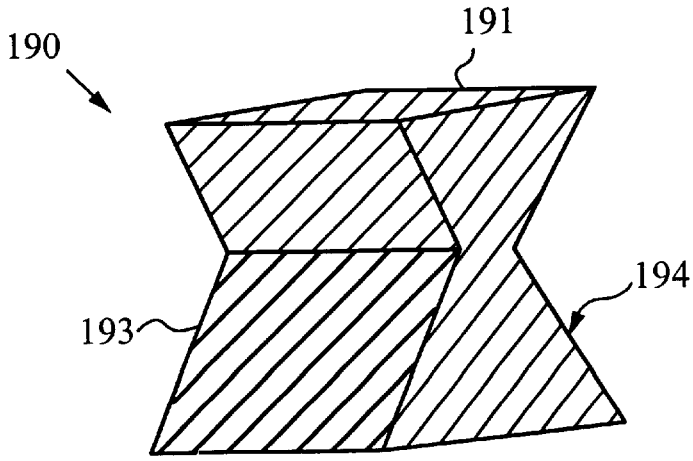
Figure 12D:
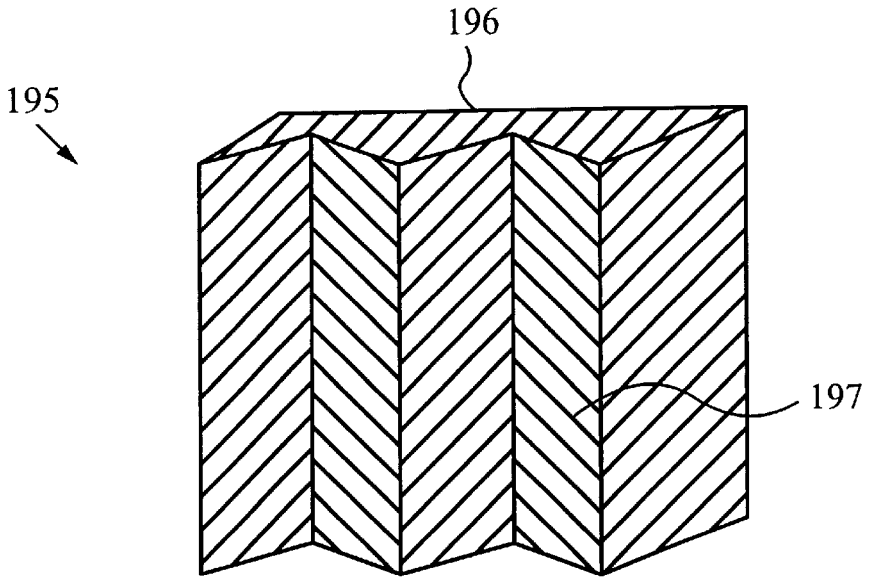

FIGS. 12*a–d* illustrate several squeegee segments with contoured squeegee walls. FIG. 12*a* illustrates a squeegee segment 170 with a planar protruding edge 171 and a concave squeegee wall 173; FIG. 12*b* illustrates a squeegee segment 180 with a planar pointed protruding edge 181 and tapered squeegee walls 183/184; FIG. 12*c* illustrates a squeegee segment 190 with a planar protruding edge 191 and concave V-shaped squeegee walls 193/194; and FIG. 12*d* illustrates a squeegee segment 195 with a jagged protruding edge 196 a grooved squeegee wall 197 that is grooved in the squeegee protruding direction.

Figure 13A:
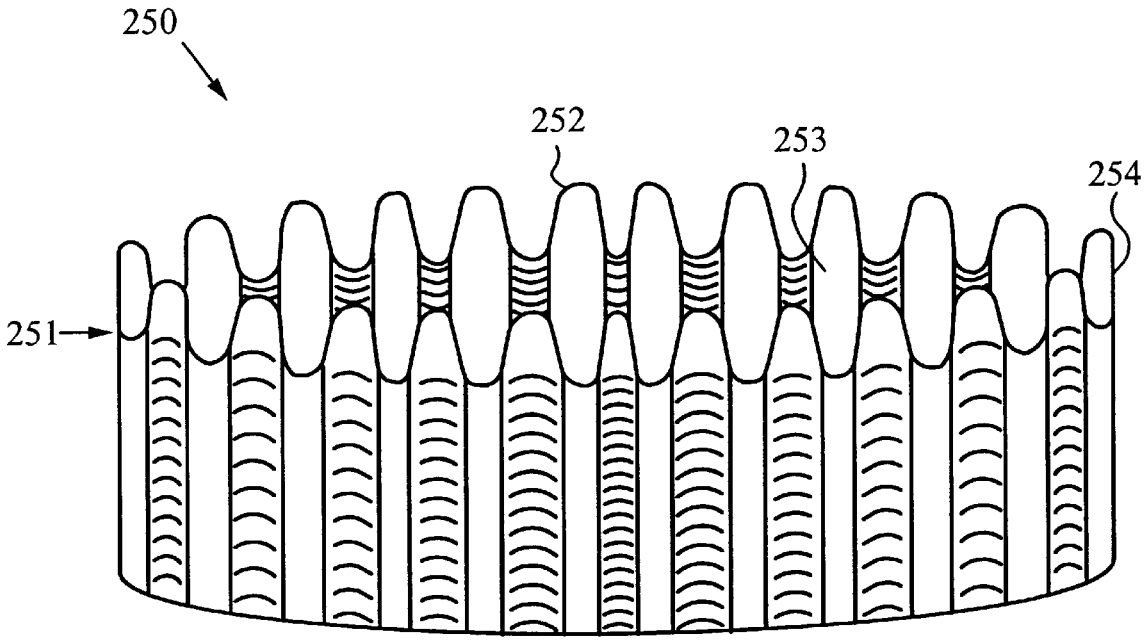
FIGS. 13*a–b* illustrate a perspective view and a top perspective view of a continuous squeegee member with contoured squeegee walls and a contoured protruding squeegee edge.
Figure 13B:
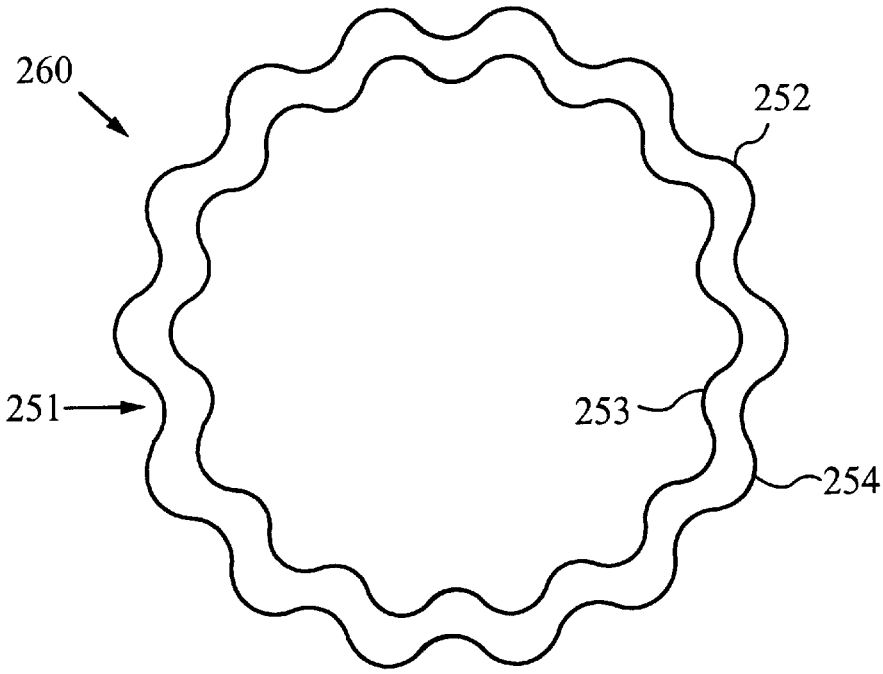

The squeegee segments in FIGS. 11*a–f* and FIGS. 12*a–d* show segments of contoured squeegee protruding edges and contoured squeegee walls, respectively. These squeegee segments are segments of linear squeegees members, circular squeegee members, spiraling squeegee members and other continuous or elongated squeegee members. FIG. 13*a* shows a perspective view 250 of a substantially circular squeegee member 251 with a contoured protruding squeegee edge 252 and a contoured squeegee walls 253/254. The protruding squeegee edged 252 and the squeegee walls 253/254 are contoured in a wave-like fashion. FIG. 13*b* is a top perspective view 260 of the squeegee member 251 to clearly show the wave-like contouring of the squeegee member walls 253/254.

Figure 14:
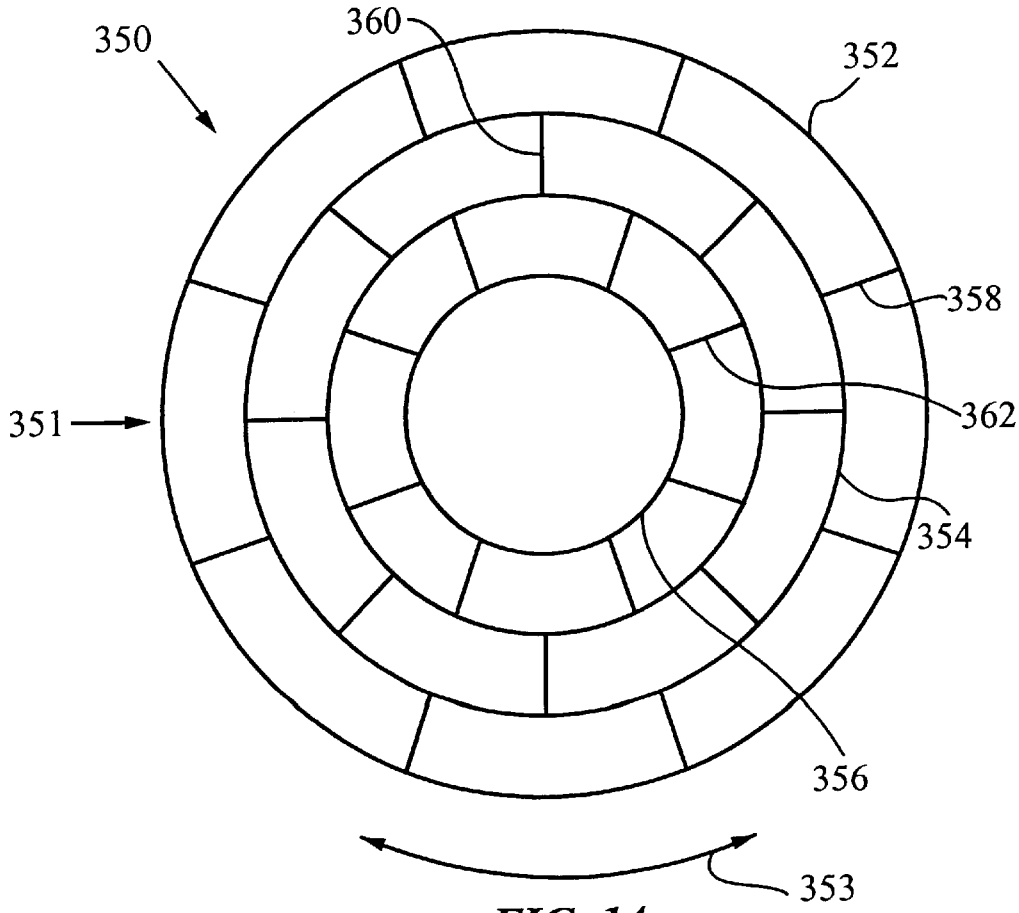
FIG. 14 is a top perspective view of a squeegee cleaning portion that provides for rotary squeegee cleaning action.

Embodiments of the present invention have many application in hand-held and hand operated squeegee cleaning devices, wherein the cleaning action is generated by moving the cleaning device across a surface. However, several of squeegee configurations also have application in rotary cleaning systems where a substantial portion of the squeegee action arises from rotational motion of a squeegee cleaning portion. FIG. 14 shows a top perspective view 350 of a squeegee cleaning portion 351 having several substantially circular squeegee members 352, 354 and 356. Positioned between circular squeegee channels, there are several radially positioned squeegee segment members 358, 360 and 362. The radially positioned squeegee segment members, 358, 360 and 362, provide rotary squeegee cleaning action when the squeegee cleaning portion 351 is attached to a rotary device (not shown) and is rotated in a rotary direction 353. Squeegee cleaning sections, such as the one illustrated in FIG. 14, have applications in rotary cleaning systems for cleaning floors and polishing surfaces.

Figure 15:
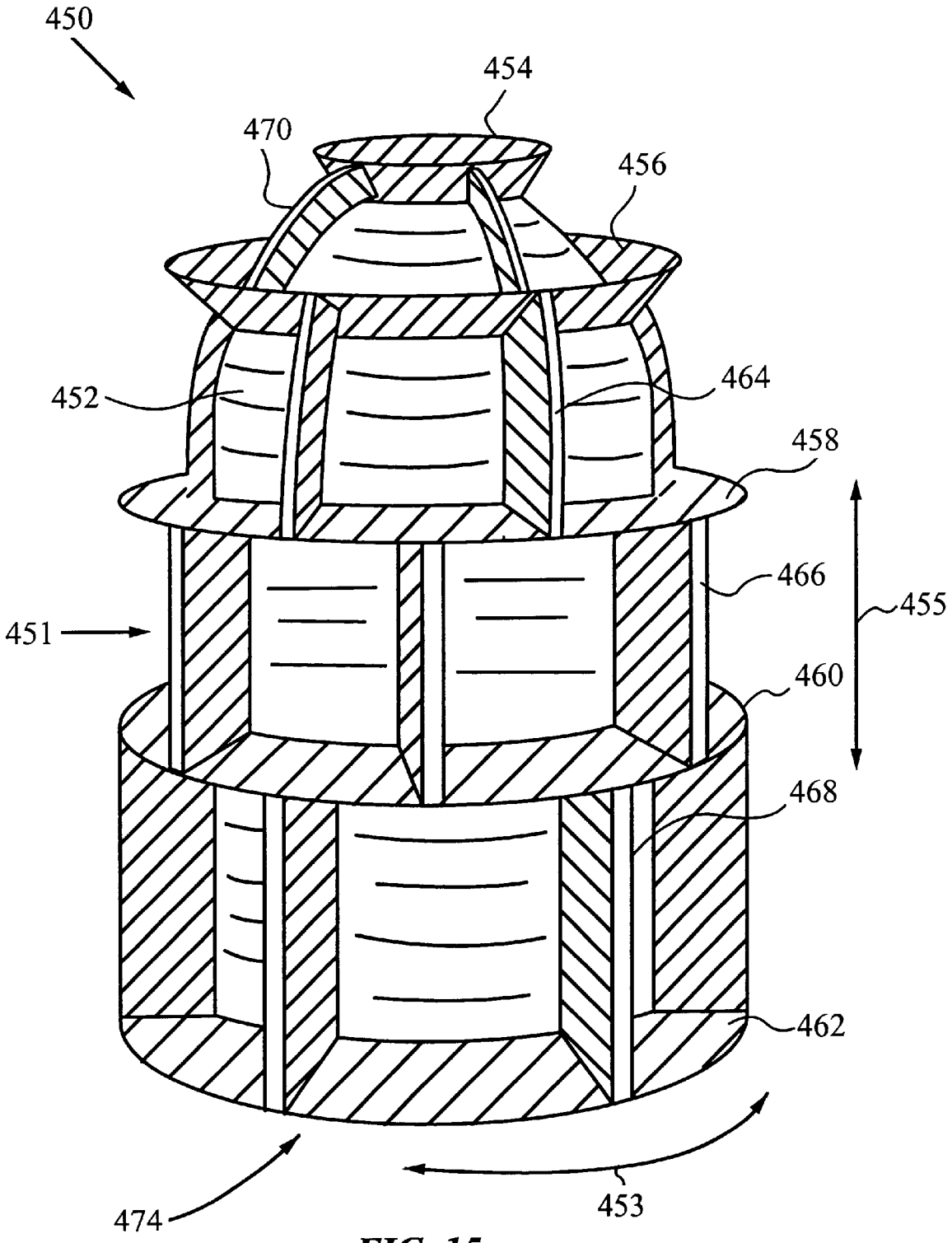
FIG. 15 is a perspective view of a contoured squeegee cleaning portion that provides for rotary squeegee cleaning action and is attachable to a rotary devices or an extendable rotary device for cleaning inner walls of cavities and vessels.

FIG. 15 shows a perspective view 450 of a rotary squeegee cleaning portion 451 that is particularly useful for cleaning inner surfaces of vessels and cavities. The rotary squeegee cleaning portion 451 has substantially circular squeegee members 458, 460 and 462 protruding from the sides of an elongated tubular squeegee support member 452. Several linear squeegee segments 468, 466 and 464 also protrude from the sides of the elongated tubular squeegee support 452 and extend in an elongated direction 455. The linear squeegee segments 468, 466 and 464 are preferably connected to the squeegee walls of the substantially circular squeegee members 458, 460 and 462. Substantially circular squeegee members 454 and 456 and linear squeegee segments 464 and 470 also protrude from the curved top portion 452 of the elongated squeegee support. The rotary squeegee cleaning portion 451 has an attachment portion 474 for attaching the rotary squeegee cleaning portion 451 to a rotary device (not shown) in order to provide squeegee cleaning action in the rotary direction 453. A rotary squeegee cleaning portion, such as that shown in FIG. 15, can be made in a variety of sizes and shapes. A larger rotary squeegee portions may be attached to an extendable rotary device and used to clean inside surfaces of glass containers or pipes. Micro-rotary squeegee portions maybe attached to catheter devices and used to clear arteries or remove tissue from the inner walls of vessels or cavities during medical procedures.

Figure 16:
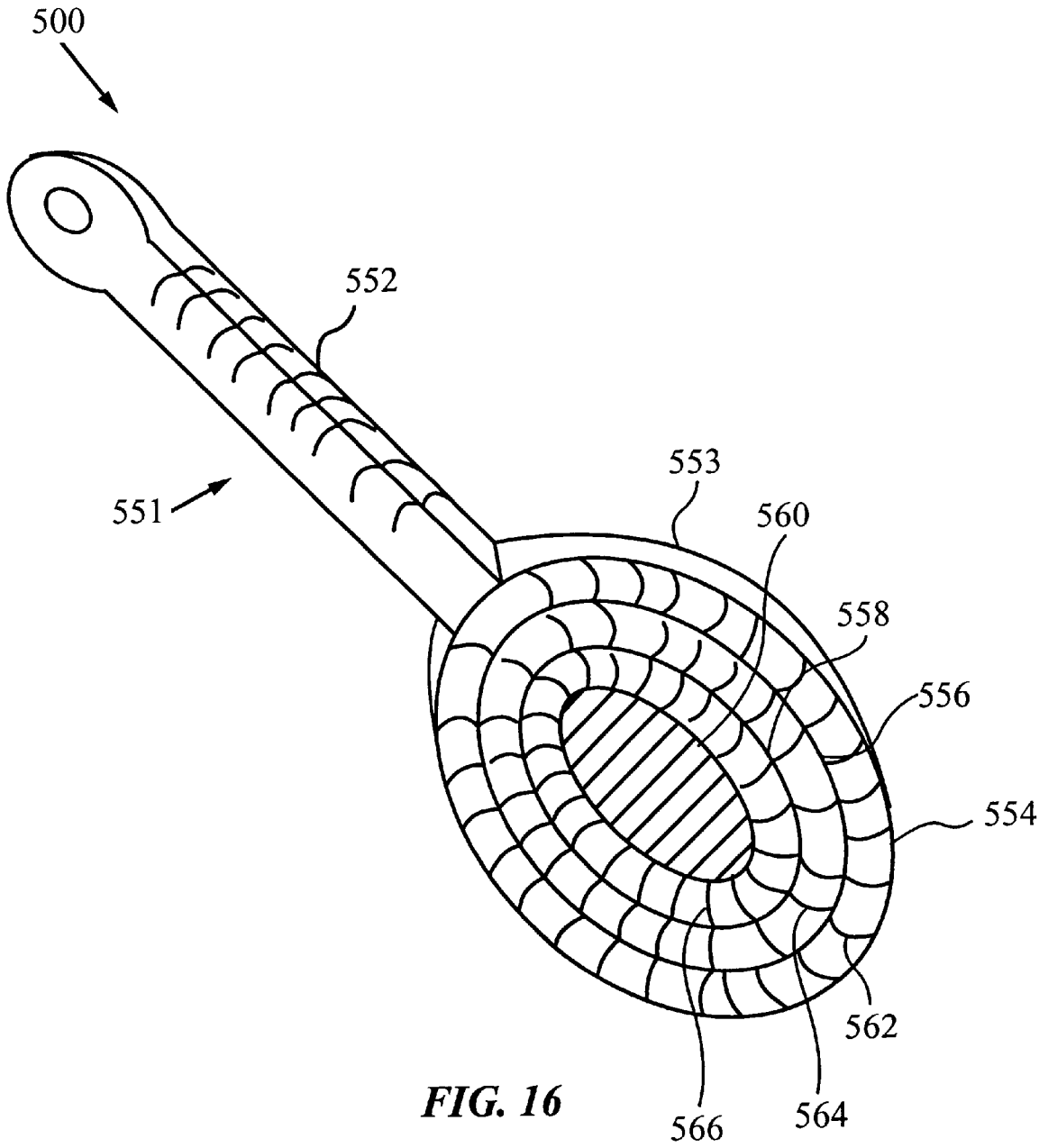
FIG. 16 is a hand-held cleaning device of the current invention for cleaning surfaces.

FIG. 16 shows a perspective view 500 of a cleaning device 551 that employs a preferred squeegee configuration. Several continuous squeegee members 554, 556, 558 and 560 protrude from a cleaning head 553. Several squeegee segments 562, 564 and 566 with curve contoured protruding squeegee edges are positioned in the squeegee channels formed by the continuous squeegee members 554, 556, 558 and 560. The cleaning head is preferably attached to a handle portion 552. The cleaning device 551 is particularly useful for cleaning dishes and the like.

Figure 17:
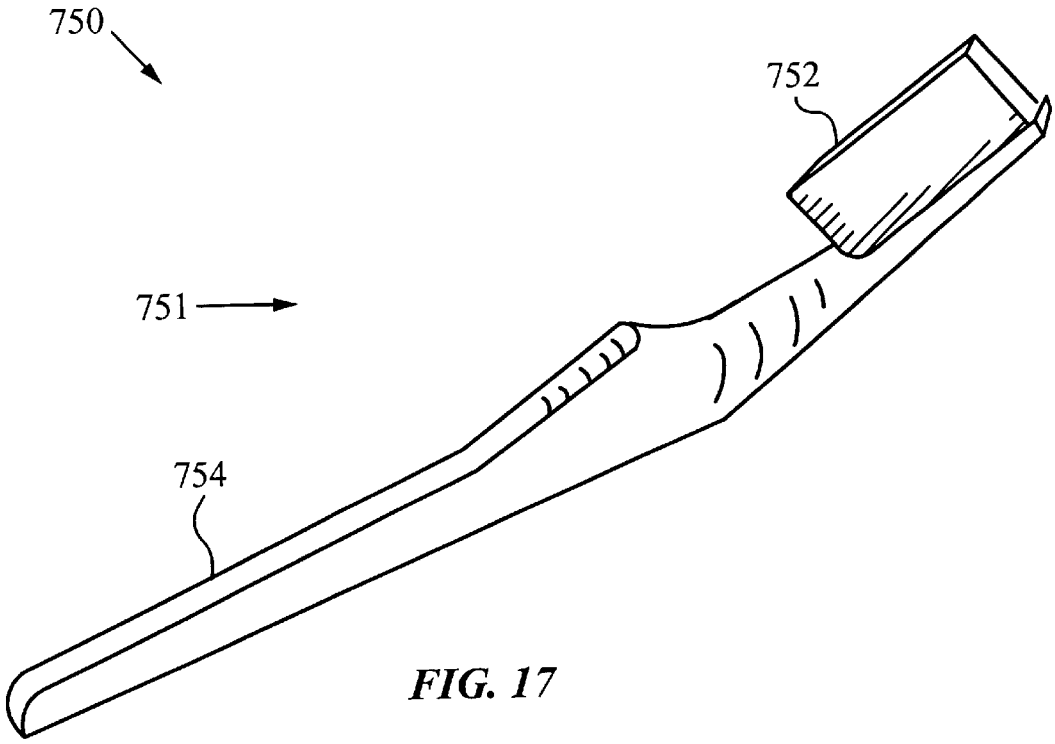
FIG. 17 is dentition squeegee cleaning device made in accordance with the current invention for cleaning teeth without deleterious abrasion to surrounding gum tissue.
Figure 18A:
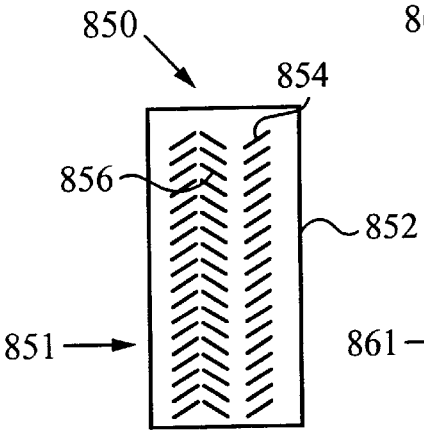
FIGS. 18*a–c* are preferred squeegee cleaning portions used in a dentition squeegee cleaning device in accordance with the present invention.
Figure 18B:
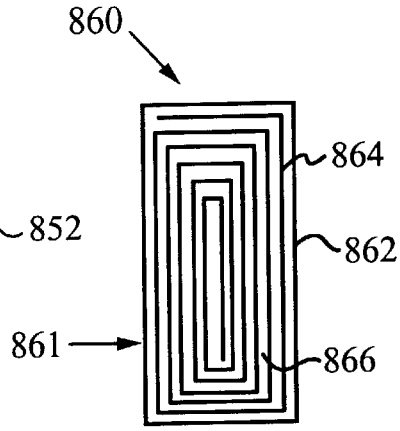
Figure 18C:
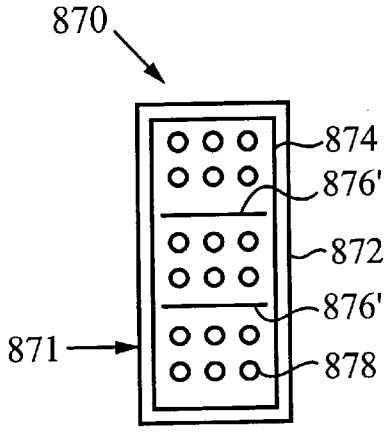

FIG. 17 shows a perspective view 750 of a dentition cleaning device 751 that has a handle portion 754 and a dentition squeegee cleaning portion 752 in accordance with the present invention. The dentition cleaning device 751 preferably has a dentition squeegee cleaning portion 752 with squeegee members configured according to FIGS. 18 *a–c*. FIG. 18*a* shows a top perspective view 850 of a dentition squeegee cleaning portion 851 with a plurality of linear squeegee segment members 854 and 856 protruding from a support member 852 and that are positioned at alternating angles. FIG. 18*b* shows a top perspective view 860 of the most preferred dentition squeegee cleaning portion 861. The dentition squeegee cleaning portion 861 has a spiraling squeegee section 864 protruding from a support 862. Preferably, the spiraling squeegee channel 866 is sufficiently narrow such that water can readily enter the channel but also has retention within the channel. FIG. 18*c* shows top perspective view 870 of an alternative dentition squeegee cleaning portion 871. A continuous squeegee member 874 and several squeegee segments 876 and 876' protrude from a support member 872. Within the inner region of the continuous squeegee member 874, and the between the squeegee segments 876 and 876', there are several bristle sections 878 protruding from the support member 872.

It will be clear to one skilled in the art that the above embodiment may be altered in many ways without departing from the scope of the invention. Accordingly, the scope of the invention should be determined by the following claims and their legal equivalents.

What is claimed is:

1. A device comprising:

an elongated squeegee member having elongated squeegee walls extending in at least two non-parallel elongation directions two or more times and protruding in at least one protruding direction; and bristles.

2. The device of claim 1, further comprising an element selected from the group consisting of a sponge and a scouring pad.

3. The device of claim 1, further comprising a squeegee template through which the elongated squeegee member is retractable and through which the at least one elongated squeegee member is extendible.

4. The device of claim 1, wherein the bristles surround the elongated squeegee.

5. The device of claim 1, further comprising a handle.

6. The device of claim 1, wherein the elongated squeegee member and the bristle are configured to simultaneously wipe and brush a surface.

7. The device of claim 6, wherein the device is an oral-care device.

8. The device of claim 1, wherein the elongated squeegee member is made from a material selected from the group consisting of silicone, rubber and urethane.

9. The device of claim 1, wherein the elongated squeegee member is a spiraling squeegee member forming a spiraling squeegee channel.

10. The device of claim 9, wherein the bristles protrude from the squeegee channel.

11. The device of claim 1, wherein the elongated squeegee member is a squiggling or wave-like squeegee member.

12. The device of claim 11, wherein the bristles surround the elongated squeegee member.

13. The device of claim 1, wherein the protruding edge of the elongated squeegee member is contoured.

14. The device of claim 1, wherein the elongated squeegee walls of the elongated squeegee member is contoured.

15. The device of claim 1, further comprising apertures, a portion of which a cleaning medium is capable of passing through and onto a surface while simultaneously wiping the surface with tile elongated squeegee and while brushing the surface with the bristles.

16. A device comprising:

a. at least one elongated squeegee member with contoured squeegee walls extending in a plane of directions and a protruding squeegee edge protruding from the squeegee support in at least one protruding direction; and b. bristles.

17. The device of claim 16, wherein the at least one elongated squeegee member is selected from the group consisting of a spiraling squeegee member and a continuous squeegee member.

18. A device comprising:

a. a squeegee support member;

b. a set of elongated squeegee walls comprising one or more continuous squeegee members encircling an inner squeegee region and protruding with squeegee edges from a surface of the squeegee support member in at least one protruding direction; and c. bristles.

19. The cleaning device of claim 18, wherein the set of elongated squeegee walls form a squeegee channel and wherein the bristled protrude from within the squeegee channel.

20. A device comprising:

a. a curved squeegee member extending in two or more directions two or more times and protruding with a squeegee edge for contacting a surface; and b. a set of bristles for contacting the surface.

21. The device of claim 20, wherein the curved squeegee member comprises a first end and a second end.

22. The device of claim 21, wherein the curved squeegee member is a spiraling squeegee member.

23. The device of claim 20, further comprising a sponge section.

24. The device of claim 20, further comprising an abrasive section.

25. The device of claim 20, further comprising apertures for treating the surface.

26. The device of claim 20, wherein the curved squeegee member and the set of bristles protrude from a support surface.

27. The device of claim 26, wherein the bristles surrounds the curved squeegee member.

28. The device of claim 26, wherein the curved squeegee member surrounds the set of bristles.

29. The device of claim 26, wherein the device is configured for cleaning teeth.

30. A device comprising a squeegee configuration comprising:

a. a squeegee curved in an elongation direction to form a curved wiping edge protruding in at least one protruding direction for wiping a surface; and b. apertures for treating the surface.

31. The device of claim 30, wherein the apertures are configured to draw a vacuum on the surface.

32. The device of claim 30, wherein the apertures are configured to apply a medium to the surface.

33. The device of claim 30, further comprises bristles for brushing the surface.

34. The device of claim 30, wherein the curved squeegee is a spiraling squeegee forming a spiraling squeegee channel.

35. The device of claim 34, wherein the apertures are positioned within the spiraling squeegee channel.

36. The device of claim 30, wherein the squeegee configuration is configured to couple to a rotary device for rotating the squeegee configuration.

37. A device comprising a squeegee configuration comprising:

a. squeegee walls forming an array of squeegee compartments; and b. bristles protruding for within one or more of the squeegee compartments, wherein the one or more of the squeegee compartments surround the bristles.

38. The device of claim 37, wherein the squeegee compartments comprise one or more squeegee channels.

39. The device of claim 37, further comprising an element selected from the group consisting of a sponge and a scouring pad.

40. A method of making a device comprising;

a. providing a support structure;

b. coupling a squeegee to the support structure, the squeegee extending in at least two directions two or more times; and c. coupling bristles to the support structure such that the squeegee and the bristles are configured to wipe and brush a surface.

41. The method of claim 40, wherein the bristles surround the squeegee.

42. The method of claim 40, wherein the squeegee surrounds the bristles.

43. The method of claim 40, wherein the support structure is a toothbrush handle.

* * * * *